US005839046A

United States Patent [19]

Takano et al.

[11] Patent Number: 5,839,046

[45] Date of Patent: Nov. 17, 1998

[54] CONTINUOUS FORM PRINTER

[75] Inventors: Masatoshi Takano; Yutaka Ishikawa; Hiroyuki Yamaguchi; Hiroyuki Saito, all of Tokyo, Japan

[73] Assignee: Asahi Kogaku Kogyo Kabushiki Kaisha, Tokyo, Japan

[21] Appl. No.: 820,006

[22] Filed: Mar. 18, 1997

[30] Foreign Application Priority Data

| | | | |
|---|---|---|---|
| Mar. 18, 1996 | [JP] | Japan | 8-088899 |
| Mar. 18, 1996 | [JP] | Japan | 8-088900 |
| Mar. 18, 1996 | [JP] | Japan | 8-088901 |
| Mar. 22, 1996 | [JP] | Japan | 8-093610 |

[51] Int. Cl.[6] ..... G03G 15/00

[52] U.S. Cl. ..... 399/384; 399/118

[58] Field of Search ..... 399/51, 118, 177, 399/195, 205, 361, 211, 384, 394, 206

[56] References Cited

U.S. PATENT DOCUMENTS

| | | | |
|---|---|---|---|
| 4,444,488 | 4/1984 | Fujii et al. | 399/118 |
| 4,949,104 | 8/1990 | Negoro et al. . | |
| 4,998,835 | 3/1991 | Negishi et al. . | |
| 5,063,416 | 11/1991 | Honda et al. | 399/384 |
| 5,113,225 | 5/1992 | Deguchi | 399/118 |
| 5,212,531 | 5/1993 | Monma et al. | 399/384 X |
| 5,432,593 | 7/1995 | Nishikawa et al. | 399/384 X |
| 5,493,318 | 2/1996 | Negoro et al. . | |
| 5,516,220 | 5/1996 | Ishikawa et al. . | |
| 5,532,811 | 7/1996 | Nishikawa et al. . | |
| 5,564,845 | 10/1996 | Yamaguchi et al. . | |

*Primary Examiner*—Sandra L. Brase
*Attorney, Agent, or Firm*—Greenblum & Bernstein, P.L.C.

[57] ABSTRACT

A printer includes a tractor unit for feeding continuous form paper, encoders driven in synchronization with the tractor unit, and detecting sensors for detecting the encoders to generate feed pulses at a standard interval. The printer further includes a paper top sensor for detecting a leading edge of the continuous form paper to generate paper top signal and is arranged to control the feed of the paper based on the feed pulse generated after the paper top signal. In order to adjust the printing position on the paper in case where the scanning position is misaligned due to a manufacturing error, the position of the detecting sensors is adjustable with respect to the encoders to compensate for the error. Further, the position of the paper top sensor is adjustable with respect to the tractor unit in order to keep the relationship between the feed pulse and the paper top signal unchanged regardless of the adjustment of the detecting sensors.

36 Claims, 23 Drawing Sheets

PRINTING PROCESS

PRINT STOP PROCESS

TOP SET PROCESS

CONTINUOUS FORM PRINTER

BACKGROUND OF THE INVENTION

The present invention relates to a printer using continuous form paper.

Printers using continuous form paper are well known. Conventionally, the continuous form paper has a discrete page length defined by perforations between pages and has feed holes at a certain interval (conventionally ½") on both sides thereof.

Conventionally, the printer includes a tractor unit which drives a pair of tractor belts having projections for engaging the feed holes of the paper. In order to provide feedback for control of the feeding of the paper, the tractor unit generally includes an encoder or the like driven in synchronization with the tractor belt for generating feed pulses at a standard interval. The standard interval corresponds to the distance between the feed holes (conventionally ½"). The printer further includes a paper top sensor for detecting a leading edge of the continuous form paper and is arranged to control the feed of the paper based on the feed pulse generated after the detection of the paper top sensor.

Generally, the page length of continuous paper is a multiple of ½" (for example, 3") and, as shown in FIG. 1A perforations for separating one page of the fanfold continuous form paper from the next page are positioned at a center position between adjacent feed holes.

However, continuous form paper with a page length being a multiple ⅙" or ⅛" (for example, 19⅙" or 25⅛") have been introduced. As shown in FIG. 1B, for a page length that is a multiple of ⅙", the relationship between the perforations and the feed holes has three patterns: a center position between adjacent feed holes (a), 1/12" from the right closest feed hole (b), and 1/12" from the left closest feed hole (c). Similarly, as shown in FIG. 1C, for a page length that is a multiple of ⅛", the relationship between the perforation and the feed hole has four patterns: a center position between adjacent feed holes (d), ⅛" from the right closest feed hole (e), centered on a feed hole (f) and ⅛" from the left closest feed hole (g). Due to these relationships, the distance from the leading edge of the paper to the closest feed hole varies, and thus, it is difficult to define the position of the leading edge of the paper accurately in relation to the position of the feed holes.

To solve the above noted problem, it is possible to provide a continuous form printer generating three kinds of signals responsive to the feed of the paper of ⅛", ⅙" and ½". The printer may include two encoders to generate signals responsive to the feed of the paper of ⅛" and ⅙", and arranged to create a signal responsive to the feed of the paper of ½" by performing an AND operation of the signals for ⅛" and ⅙" feeds.

As shown in FIG. 2, if a signal responsive to the feed of the paper of ⅙" is used for paper that has a page length that is a multiple of ⅙", the relationship between the perforation and the feed holes is an integral number of ⅙" paper feed pulses such that the perforation should always be coincident with a feed pulse. Similarly, if a signal responsive to the feed of the paper of ⅛" is used for paper that has a page length that is a multiple of ⅛", the relationship between the perforation and feed holes is an integral number of ⅛" paper feed pulses such that the perforation should always be coincident with a feed pulse. However, since the leading edge of the continuous paper is formed by cutting or ripping pages at a perforation, the leading edge may be irregular. This irregularity of the leading edge changes the timing with regard to when the leading edge is detected by the paper top sensor.

FIG. 3 shows an example of a possible relationship between a paper top signal from the paper top sensor and, in this example, the ⅛" feed pulses. If the paper top signal, is designed to be generated a predetermined amount before the feed pulse n, but, due to an irregularity, is generated after the feed pulse n, the printer will then control the feed of the paper based on the feed pulse n+1 as coinciding with the perforation. This causes a deviation of the printing position on the continuous paper.

This problem was addressed in U.S. Pat. No. 5,564,845, which discloses a printer arranged to count the number of motor pulses issued to a driving motor (used for driving the tractor unit) after a signal is generated by the paper top sensor, but before the feed pulse is generated. In particular, the interval between the motor pulses is set to 1/43 of the ⅛" feed pulse. If the counted number of motor pulses is more than a threshold value (for example 23), the signal from the paper top sensor is assumed to have been delayed, and therefore the printer compensates in determining the related feed pulse. If the counted number of motor pulses is less than the threshold value, the controller does not perform this compensation. In particular, the threshold value is determined after mounting the tractor unit, the paper top sensor and the encoders to the printer.

However, a further problem arises due to the use, in an electro-photographic printer having a scanning unit (for example, a laser scanning unit) for creating a latent image on a photo-conductive drum. Due to manufacturing errors of the scanning unit, the scanning position on the photo-conductive drum surface (and therefore on the paper) may deviate from the designed position. As shown in FIG. 4, if the scanning position deviates in a direction perpendicular to the scanning direction (i.e., in the direction in which the paper is fed), the printing position (PP) on the paper also deviates as shown by A and B in FIG. 4. This error must also be compensated for during assembly of the printer, however, the compensation must be achieved without affecting the relationship between the paper top sensor and the feed pulses.

SUMMARY OF THE INVENTION

It is therefore an object of the present invention to provide a continuous-form printer capable of using papers with different page length, wherein it is possible to compensate the printing position on the paper.

According to one aspect of the present invention, a printer using continuous form paper includes; a tractor unit for feeding the paper, a feed pulse generating device for generating a feed pulse responsive to a feeding interval, a paper top sensor for detecting the leading edge of the paper and generating a paper top signal, a controller which controls the tractor unit according to the feed pulse, and a mechanism for adjusting the printing position on the paper while keeping a relationship between the feed pulse and the paper top signal unchanged.

As constructed above, if the scanning position has a manufacturing error, the printing position on the paper can be adjusted to compensate for the error without affecting the relationship between the feed pulse and the paper top signal.

In one preferred embodiment, the feed pulse generating means includes at least one encoder driven in synchronization with the tractor unit and at least one detecting sensor for detecting the movement of the encoder. The position of the detecting sensor is adjustable with respect to the encoder to thereby change the timing of the feed pulse. The position of the paper top sensor is adjustable with respect to the tractor unit. As constructed above, it becomes possible to adjust the position of the paper top sensor, after adjusting the position of the detecting sensor.

Preferably, the detecting sensor is supported on a first support member slidably provided to a tractor frame of the tractor unit. The paper top sensor is supported on a second support member slidably provided to the tractor unit. The first and second support members are independently slidable. With this, the position of the paper top sensor and the detecting sensor can be adjusted in a simple manner. Further, the printer further includes a guiding device for guiding each of the first and second support members in a paper feeding direction with respect to the tractor frame. With this, it becomes possible to perform the adjustment in a correct direction.

In another preferred embodiment, the detecting sensor and the paper top sensor are supported on a common support member, the common support member being slidably provided to the tractor unit. As constructed above, if the scanning position has manufacturing error, the printing position on the paper can be adjusted by sliding the common support. Since both the paper top sensor and the detecting sensor are supported on the common support, the relationship between the feed pulse and the paper top signal is not changed by the above adjustment.

Preferably, the detecting sensor is positioned so that the direction of movement of the encoder with respect to the detecting sensor coincides with a paper feeding direction. The photo-interrupter is positioned at a plane of the paper on the tractor unit. Further, the guiding device is provided for guiding the common support member in a paper feeding direction with respect to the tractor frame.

In another preferred embodiment, the encoder, the detecting sensor and the paper top sensor are unitarily provided in one frame that is supported on a base. As constructed above, if the scanning position has manufacturing error, the printing position on the paper can be adjusted by sliding the tractor frame. Since the encoder, the detecting sensor and the paper top sensor are supported on the tractor frame in a paper feeding direction, the relationship between the feed pulse and the paper top signal is not changed by the above adjustment. Preferably, the printer further includes the guiding device for guiding the frame in a paper feeding direction with respect to the base.

According to another aspect of the invention, the printer includes a tractor unit for feeding the paper, a scanning unit for emitting light according to a pattern to be printed, a photo-conductive member which receives the light to form a latent image, a device for developing the latent image on the photo-conductive member, transferring the developed image onto the paper and fixing the transferred image onto the paper; and an adjusting mechanism for adjusting the position of the emitted light of the scanning unit on the photo-conductive member, the adjusting mechanism being operable when the scanning unit is mounted on the printer.

In one preferred embodiment, the photo-conductive member is a photoconductive drum and the adjusting mechanism allows adjustment of the position of the emitted light around the circumference of the photo-conductive drum. Further, the scanning unit includes a reflecting member for directing the emitted light to the photo-conductive member, and a reflecting angle of the reflecting mirror can be adjusted.

Preferably, the reflecting member is supported by an abutting member and a biasing member which biases the reflecting mirror so that the reflecting mirror abuts to the abutting member. The abutting member is a screw member engaging a threaded hole formed on a casing of the scanning unit. The casing of the scanning unit is provided with an opening through which a tool can be inserted to operate the screw member. As constructed above, the adjusting of the reflecting angle of the reflecting mirror can be performed in a simple manner. The opening is sealed by a sealing member after the adjustment.

In another preferred embodiment, the scanning unit is housed in a casing, the casing being shifted on a base in a paper feeding direction. The casing is provided with an elongated hole extending in a paper feeding direction and a screw fixed to the base through the elongated hole. Preferably, the printer further includes guiding means for guiding the casing in a paper feeding direction with respect to the base.

DESCRIPTION OF THE ACCOMPANYING DRAWINGS

DESCRIPTION OF THE EMBODIMENTS

Figure 5:
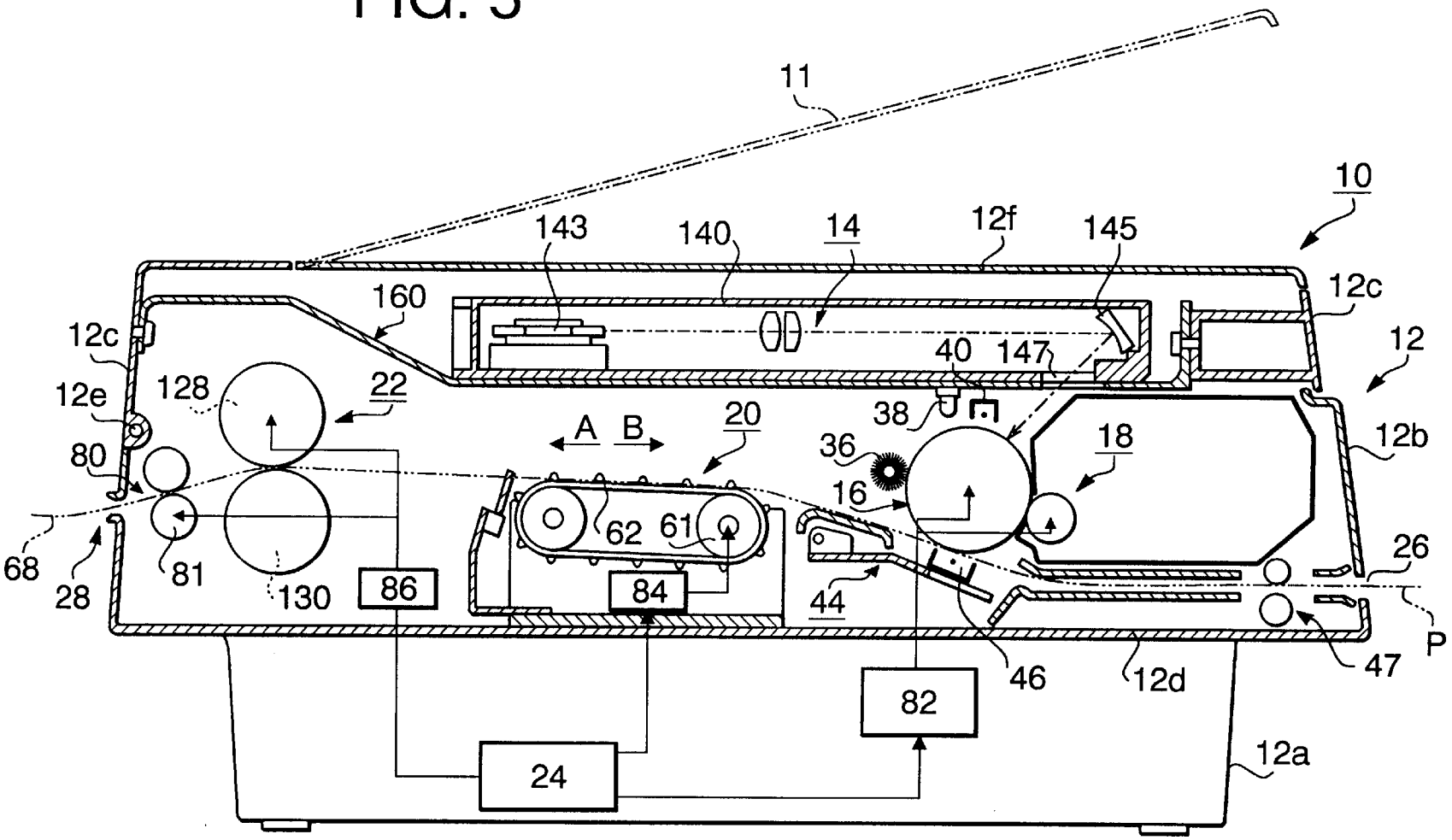
FIG. 5 is a side sectional view showing an internal structure of a printer.

FIG. 5 is a side view showing the internal structure of a printer 10. The printer 10 includes a housing 12, a laser scanning unit 14, a photo-conductive drum 16, a developing unit 18, a transfer unit 44, a tractor unit 20, and a fixing unit 22.

The housing 12 is divided into lower, middle and upper portions 12*a*, 12*b*, and 12*c* respectively. The lower portion 12*a* houses a controller 24.

The middle housing 12*b* houses the fixing unit 22, the photo-conductive drum 16, the developing unit 18, the transfer unit 44, and the tractor unit 20. A paper inlet 26 and a paper outlet 28 are provided on opposite sides of the middle housing 12*b*. A paper path 68 is defined extending from the inlet 26, through a pair of back tension rollers 47, passing between the photoconductive drum 16 and the transfer unit 44, extending over the tractor unit 20, passing through the fixing unit 22, and extending to the outlet 28.

The upper housing 12*c* is provided with a support frame 160 for supporting the scanning unit 14 therein. The upper portion 12*c* is swingably supported relative to the middle housing 12*b* by a pivot assembly 12*e*, and can be swung away from the middle housing 12*b*, thereby allowing access to the paper path 68.

Initially, paper P (continuous forms type) is inserted from the inlet 26 with the upper housing 12*c* swung open, and is fed by hand through the pair of back tension rollers 47, between the photoconductive drum 16 and the transfer unit 44, to the tractor unit 20. The tractor unit 20 is arranged on a main chassis 12*d* of the housing 12 to feed the paper P in a forward direction (arrow A) and a reverse direction (arrow B) along the paper path 68.

In a printing process, the scanning unit 14 is controlled by the controller 24 to generate a scanning laser beam that scans along the length of the photoconductive drum 16 while the photoconductive drum 16 is rotated in order to form a latent image on the photoconductive drum 16.

The developing unit 18 applies toner to the latent image to form a toner image on the photoconductive drum 16. The transfer unit 44 is disposed on the opposite side of the paper path 68 from the photoconductive drum 16 and transfers the toner image from the photoconductive drum 16 onto the paper P.

The fixing unit 22 includes a heat roller 128 and a pressure roller 130, for fixing a toner image to the paper P by heat and pressure. The heat roller 128 is driven by a fixing unit motor 86. The pressure roller 130 is freely rotatable and vertically movable. A pair of discharge rollers 80 are provided between the outlet 28 and the fixing unit 22, the lower discharge roller 81 is driven by the fixing unit motor 86 in synchronization with the heat roller 128.

The paper P is fed forward by the tractor unit 20 in correspondence to the rotation of the photoconductive drum 16 during the above operations and thereafter to advance the paper P to the fixing unit 22. Although the heat roller 128, pressure roller 130 and discharge rollers 80 are in contact with the paper P during printing, the feeding speed is determined by the tractor unit 20.

The printer 10 also includes a toner cleaning brush 36 for removing toner remaining on the photoconductive surface of the drum 16, a discharging unit 38 for removing a charge on the photoconductive drum 16, and a charging unit 40 for uniformly charging the photoconductive surface of the drum 16, that are provided around the circumference of the photo-conductive drum 16.

The controller 24 controls a main motor 82 to drive the photo-conductive drum 16 and the developing unit 18; a tractor motor 84 to feed the paper P; and the fixing unit motor 86 for driving both the heat roller 128 and the lower discharge roller 81.

Figure 6:
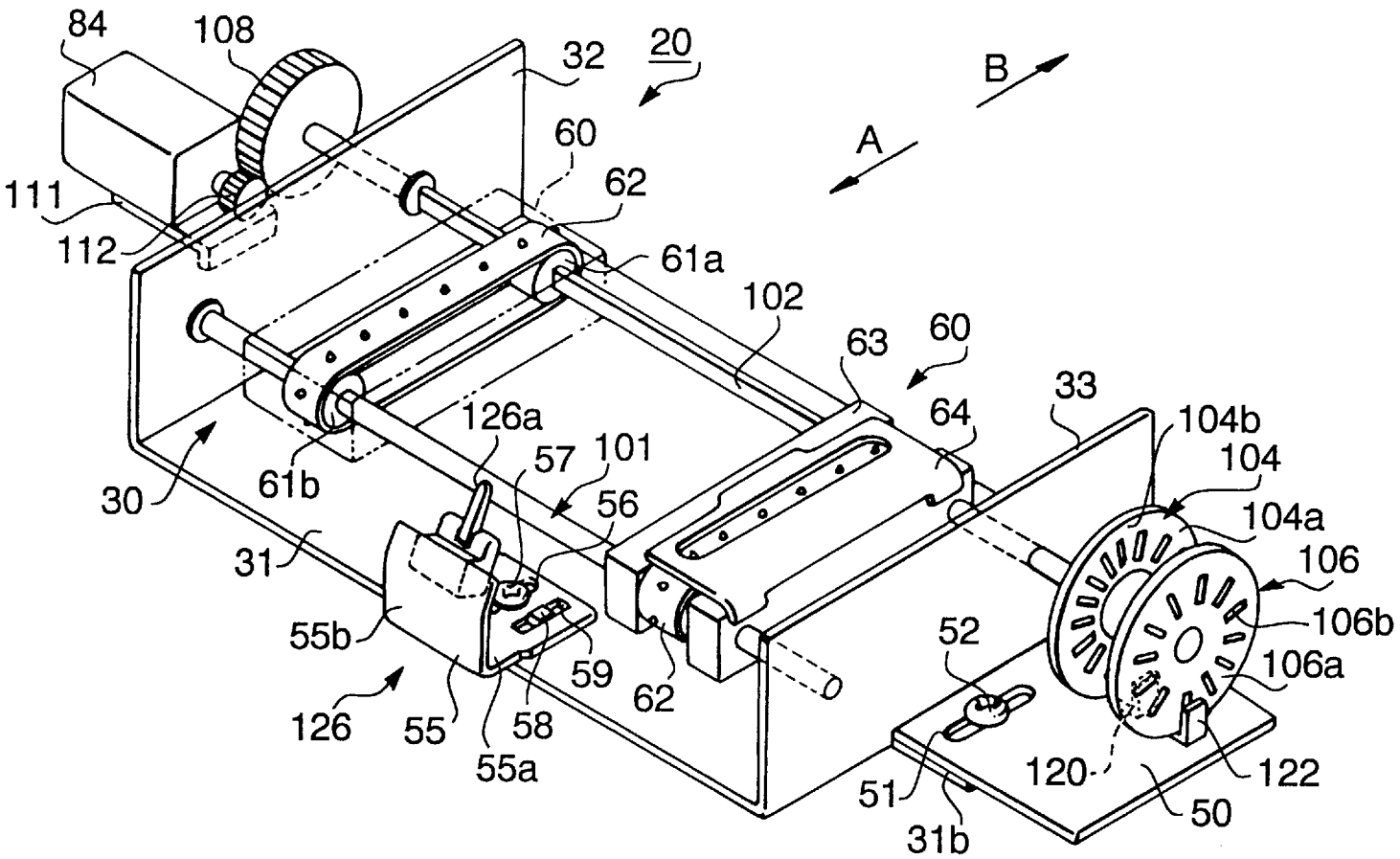
FIG. 6 is a perspective view of a tractor unit of the printer.
Figure 7:
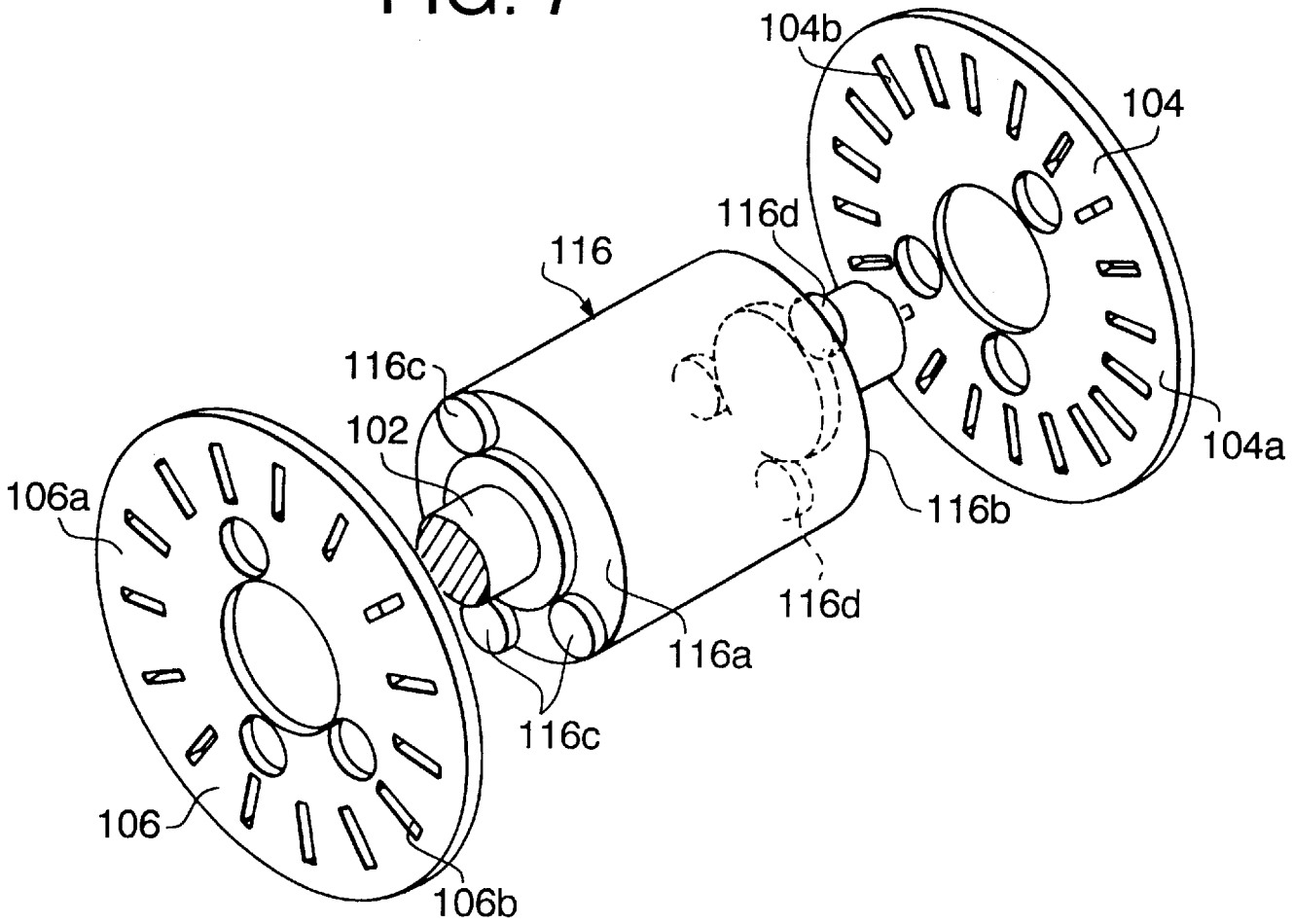
FIG. 7 is an exploded perspective view showing encoders for the tractor unit.
Figure 8:
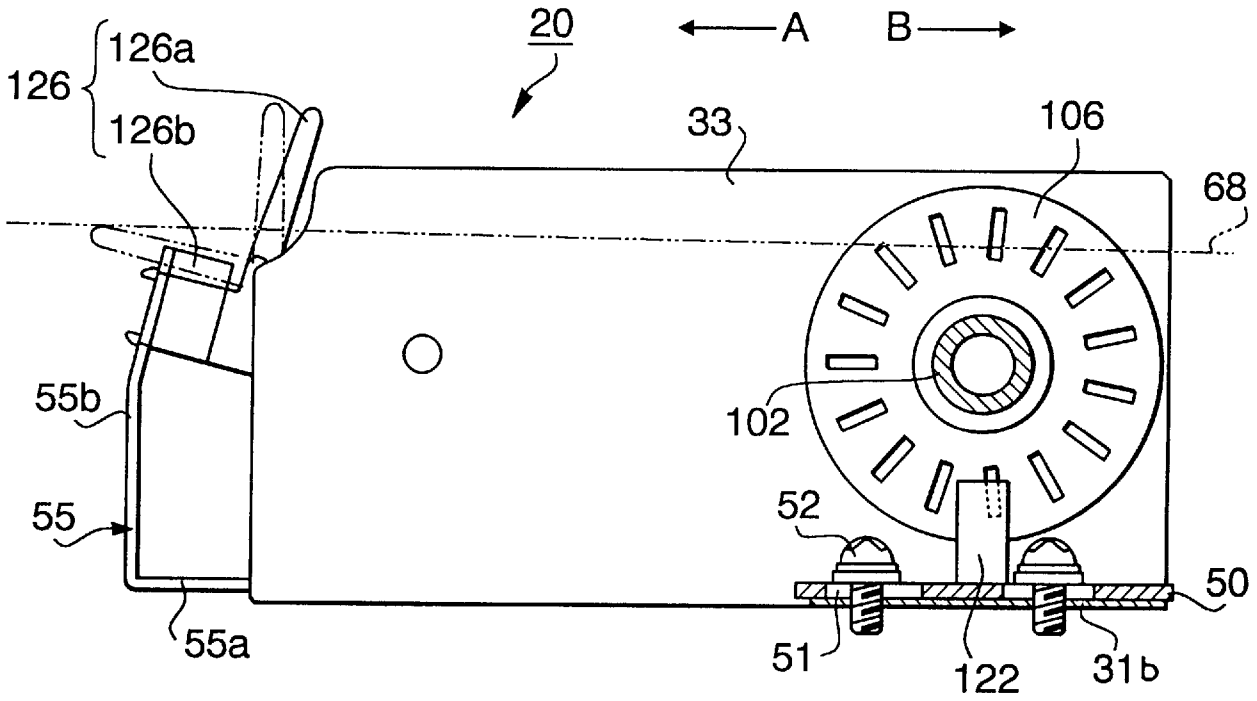
FIG. 8 is a side view of the tractor unit.

A detailed description of the tractor unit 20 will now to be provided with reference to FIGS. 6 to 8. FIG. 6 is a perspective view of the tractor unit 20. The tractor unit 20 includes a U-shaped tractor frame 30 provided on the main chassis 12*d* (FIG. 5). The U-shaped tractor frame 30 includes a bottom plate 31 and two side plates 32. The tractor unit 20 further includes a pair of tractors 60 arranged parallel with each other along the paper feed path 68 (FIG. 5). Each tractor 60 has a tractor belt 62 having projections which engage with the feed holes of the paper P, a pair of pulleys 61*a* and 61*b* for driving the tractor belt 62, and an upper cover 64 for securing the engagement between the feed holes and the projections of the tractor belt 62.

The pulleys 61*a* and 61*b* of each tractor 60 are supported by a support shaft 101 and a drive shaft 102, respectively. Both the support shaft 101 and the drive shaft 102 extend between the side plates 32 and 33. The drive shaft 102 is driven by a driven gear 108 at an end near the side plate 32, and drives the tractors 60. The tractor motor 84 is mounted in a motor bracket 111 fixed to the outside of the side plate 32. The tractor motor 84 drives the driven gear 108 via a pinion 112 mounted to a motor shaft 84*a*.

Feed pulses responsive to the feed of the paper P by intervals of ⅛", ⅙, and ½ are generated by a first rotary encoder 104 and a second rotary encoder 106. The first rotary encoder 104 and the second rotary encoder 106 are coaxially attached to the drive shaft 102. The first encoder 104 is encoded to generate a feed pulse for every ⅙" of paper feed and the second encoder 106 is encoded to generate a feed pulse for every ⅛" of paper feed. The movement of the first encoder 104 and the second encoder 106 are detected by first and second sensors 120 and 122, respectively.

FIG. 7 is an exploded perspective view of the arrangement of the first and second encoders 104 and 106. The first encoder 104 includes a disk 104*a* having, for example, 20 encoder slits 104*b* extending radially at intervals corresponding to ⅛" of paper feed. The second encoder 106 includes a disk 106*a* having, for example, 15 encoder slits 106*b* extending radially at intervals corresponding to ⅙" of paper feed. The slits 104*b* and 106*b* of the first and second encoders 104 and 106 are of the same size and radial position.

The first and second encoders 104 and 106 are mounted to a positioning sleeve 116 in such a manner that every third slit 106*b* of the second encoder 106 and every fourth slit 104*b* of the first encoder 104 are aligned, thus, representing a feed pulse at intervals corresponding to ½" of paper P feed. In this example, a total of five predetermined combinations of each of the slits 104*b* and 106*b* respectively are thus aligned with each other.

In order to align the first and second encoders 104 and 106 appropriately, the positioning sleeve 116 is provided with three bosses 116*c* on one side surface 116*a*, and three opposing bosses 116*d* on the parallel opposite side surface 116*b*, each of the bosses being provided adjacent to the drive shaft 102. The bosses 116*c* and 116*d* mate with corresponding positioning holes provided in the first and second encoders 104 and 106, thus accurately determining the position of the encoders 104 and 106.

Referring again to FIG. 6, the first and second sensors 120 and 122 are, for example, photo-interrupter sensors including a light receiving element and a light emitting element. The first and second sensors 120 and 122 output OFF signals when light is blocked by the encoders 104 and 106 and ON signals when light passes through the slits 104*b* and 106*b*, respectively. The feed pulses are as follows, the ON signal from the first sensor 120 (⅙" feeding interval); the ON signal from the second sensor 122 (⅛" feeding interval); and the ON signal from both the first and second sensors 120 and 122 (½" feeding interval). A selector 124 (described below with reference to FIG. 9) is provided for selecting the feed pulse from among ⅙", ⅛" and ½" to be monitored according to the required feeding interval. The controller 24 is thereby able to monitor the feed of the paper P by any of three feed intervals.

In the first embodiment, in order to perform an adjustment described below, the position of the first and second sensors 120 and 122 is adjustable in the paper feeding direction along the paper feed path 68 (shown by the arrows A and B in FIG. 6). In particular, the first and second sensors 120 and 122 are fixed to a mounting plate 50. The mounting plate 50 is supported on a base plate 31*b* extending from the bottom plate 31. The mounting plate 50 is provided with an elongated hole 51 that extends in the paper feeding direction. A screw 52 is inserted through the elongated hole 51 and engaged to a threaded hole (not shown) formed on the base plate 31*b*. Thus, the position of the first and second sensors 120 and 122 can be adjusted by loosening the screw 52, moving the mounting plate 50 and tightening the screw 52.

Figure 1A:
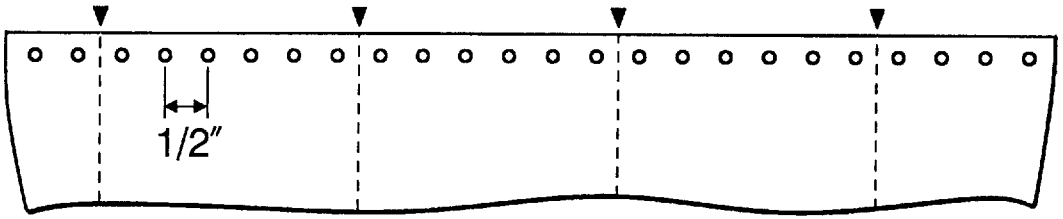
FIG. 1A PRIOR ART
FIGS. 1A, 1B, 1C are schematic views of various continuous form papers having different page lengths.
Figure 1B:
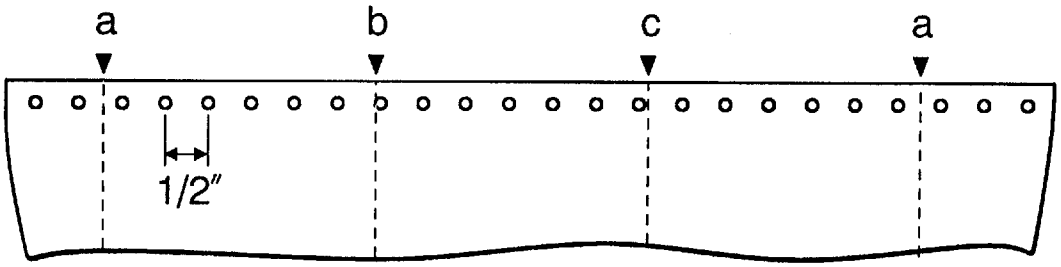
FIG. 1B PRIOR ART
Figure 1C:
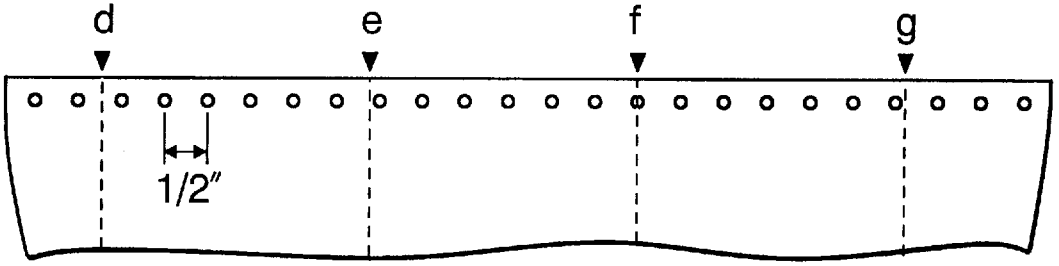
FIG. 1C PRIOR ART
Figure 2A:
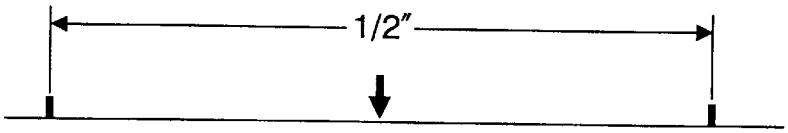
FIG. 2A PRIOR ART
FIGS. 2A, 2B, 2C are schematic views of various feed pulses.
Figure 2B:
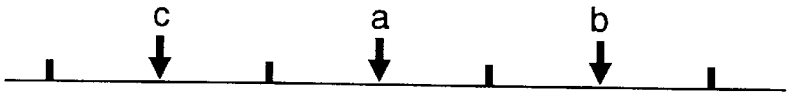
FIG. 2B PRIOR ART
Figure 2C:
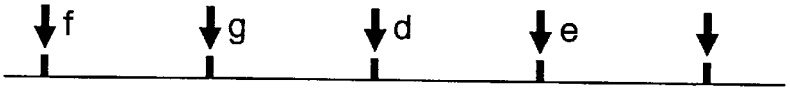
FIG. 2C PRIOR ART

The tractor unit 20 is further provided with a paper top sensor 126 for detecting the leading edge of the paper P. As shown in FIG. 6, the paper top sensor 126 is positioned between the tractors 60 at one side of the tractor unit 20 such that as the paper P is fed forward (the direction indicated by the arrow A in FIG. 6) the paper P will contact the paper top sensor 126. FIG. 8 is a side view of the tractor unit 20. As shown in FIG. 8, the paper top sensor 126 includes an actuator 126*a* and a sensor body 126*b*. The paper top sensor 126 generates an OFF signal when the actuator 126*a* projects vertically (i.e., into the paper path 68 shown in FIG. 5), and generates an ON signal when the actuator 126*a* is pushed to a horizontal position (i.e., below the paper path 68) by the paper P. The controller 24 (FIG. 1) monitors the paper top sensor 126.

In the first embodiment, in order to perform an adjustment described below, the position of the paper top sensor 126 is also adjustable along the paper feed path 68 (as shown by arrows A and B in FIG. 6). In particular, as shown in FIG. 6, the paper top sensor 126 is fixed to a mounting member 55. The mounting member 55 includes a bottom portion 55*a* and an upright portion 55*b* to which the paper top sensor 126 is secured. The bottom portion 55*a* is provided with an elongated hole 56 that extends in the paper feeding direction. A screw 57 is inserted through the elongated hole 56 and engaged to a hole (not shown) on the bottom plate 31. Thus, the position of the top sensor 126 can be adjusted by loosening the screw 57, moving the mounting member 55 and tightening the screw 57. Further, for guiding the mounting member 55 in the paper feeding direction, the bottom portion 55*a* is provided with a guide groove 58 extending in the paper feeding direction, to which a square boss 59 provided on the bottom plate 31 engages.

As constructed above, both the position of the first and second sensors 120 and 122 and the position of the paper top sensor 126 can be adjusted in the paper feeding direction.

Figure 9:
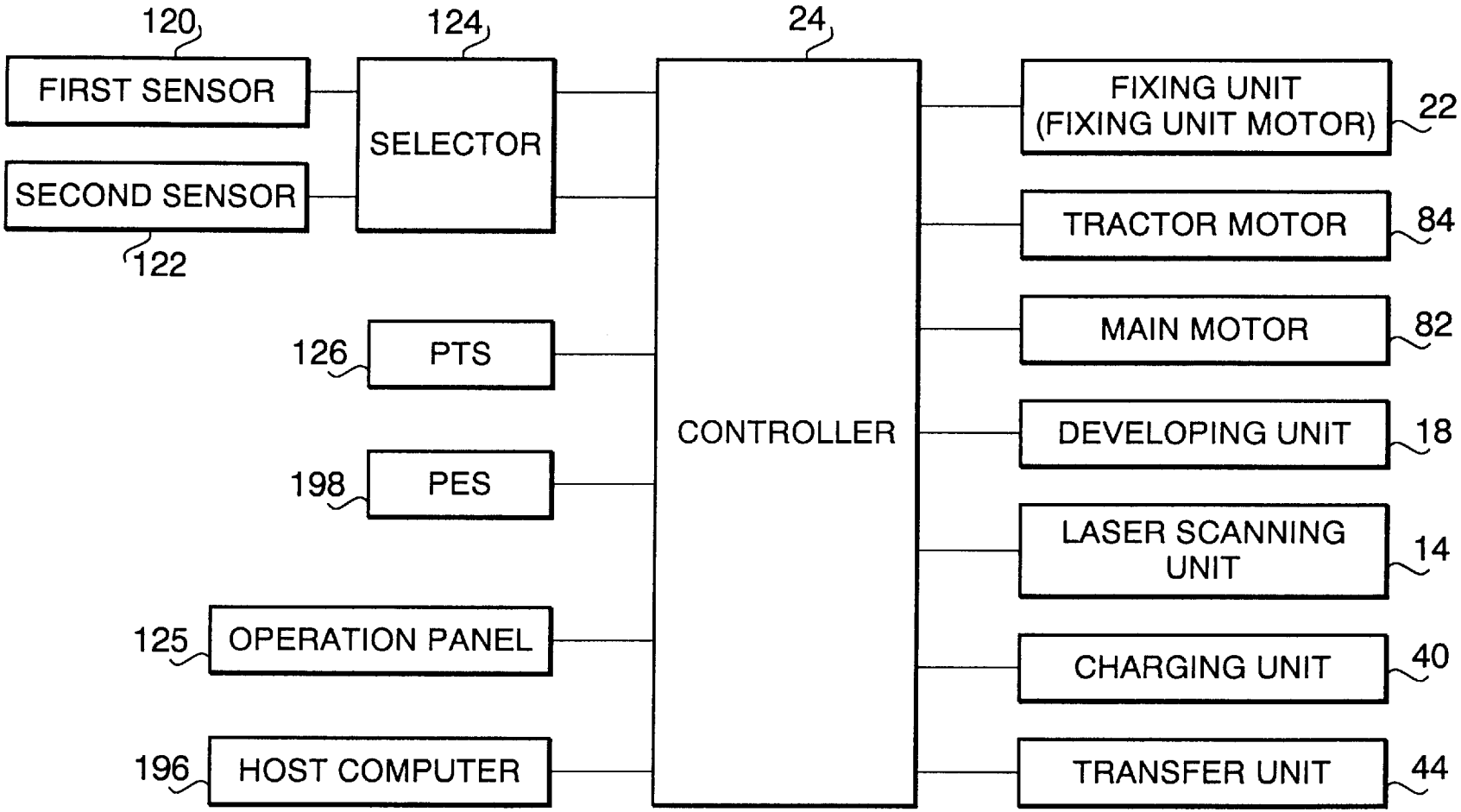
FIG. 9 is a block diagram of a control system of the printer.

A control of the printer 10 will be described with reference to FIGS. 9 through 18. FIG. 9 is a block diagram showing the control system for the printer 10. The controller 24 is connected to the laser scanning unit 14, the main motor 82, the developing unit 18, the fixing unit 22 (including the fixing motor 86), and the tractor motor 84. Further, the controller 24 is also connected to an operation panel 125 for the input of data, such as the feeding interval or the like, the paper top sensor 126 (PTS), the paper empty sensor 198 (PES), and a host computer 196 from which the controller 24 receives data, such as printing data, the feeding interval, or the like. The controller 24 is also connected to the first and second sensors 120 and 122 via the selector 124.

Figure 10:
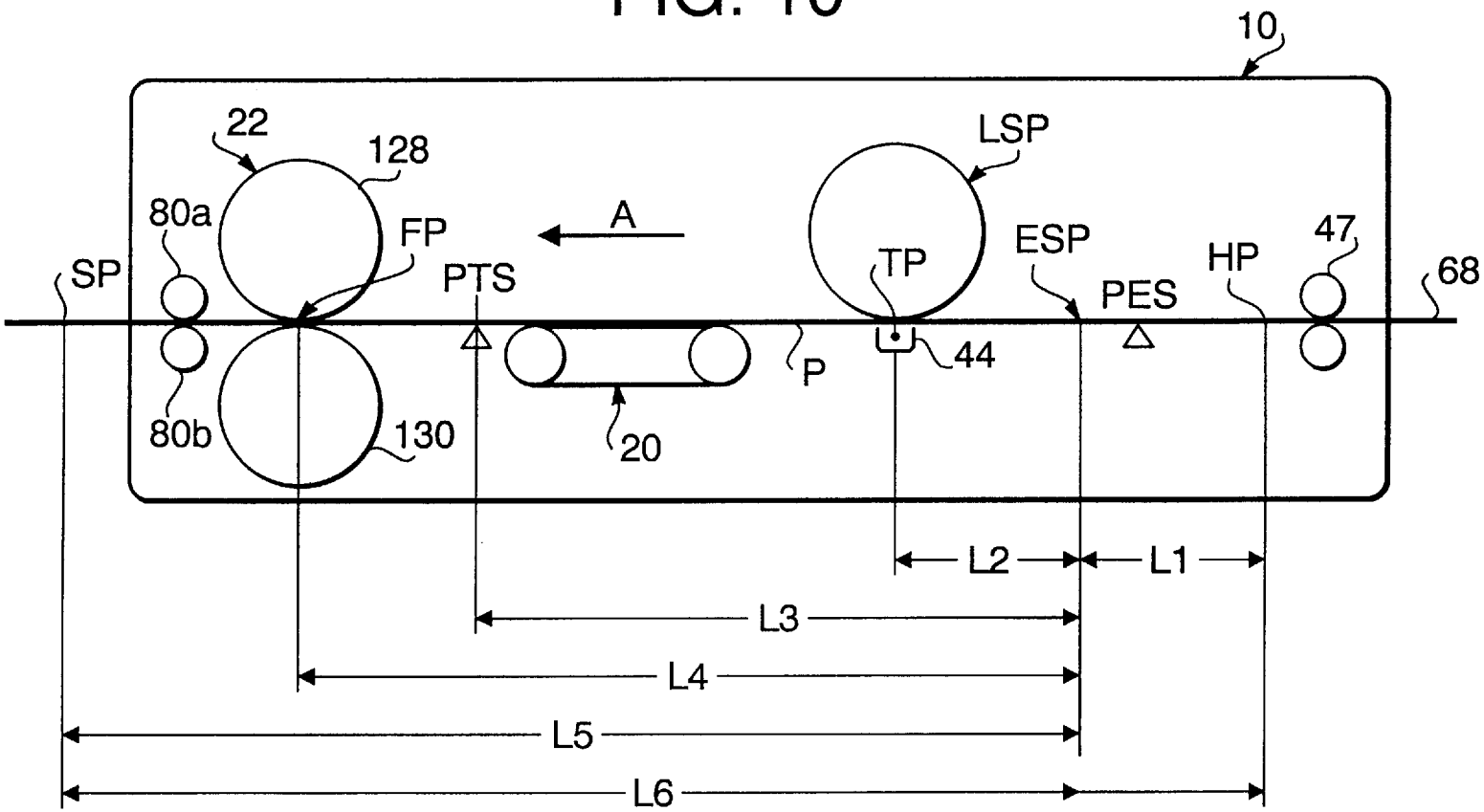
FIG. 10 is a schematic view showing sensor and control positions of the printer.
Figure 11:
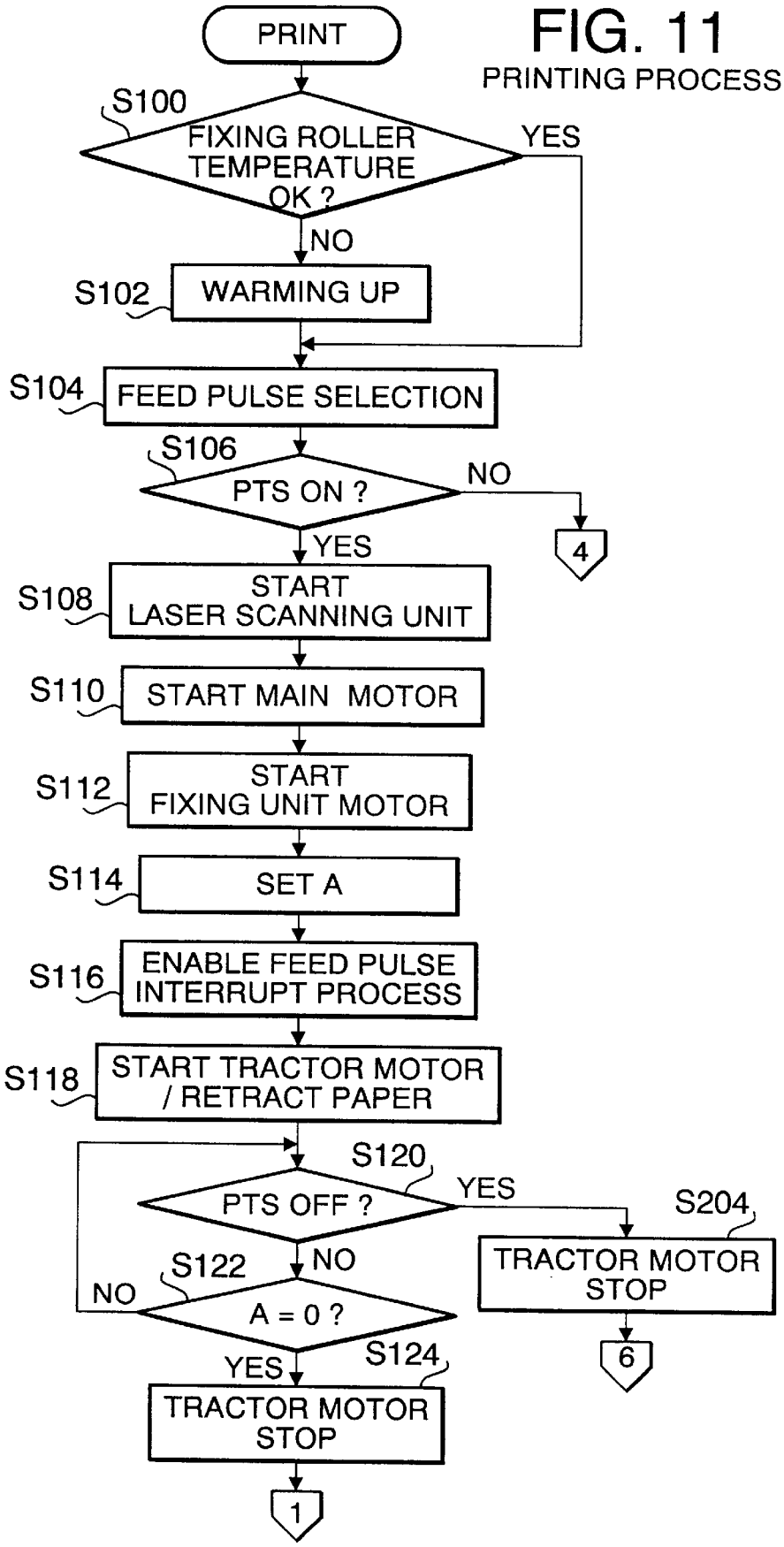
FIG. 11 is a flow chart showing a first part of a printing control process.

FIG. 10 is a schematic diagram showing various positions and length parameters defined in relation to the paper path 68 for use by the control process described herein. A transfer position TP is defined as the position between the photoconductive drum 16 and the transfer unit 44 at which the toner is transferred. A home position HP is defined as a predetermined position between the paper empty sensor PES and the pair of back tension rollers 47. A laser scanning position LSP is defined as a position on the surface of the photoconductive drum 16 onto which the scanning laser beam is emitted. An exposure start position ESP is defined as a position, along the paper path 68, upstream of the transfer position TP by a distance that is equal to the circumferential distance from the transfer position TP to the laser scanning position LSP, along the surface of the photoconductive drum 16. A fixing position FP is defined at the nip between the rollers 128 and 130 of the fixing unit 22. A paper top sensor position PTS is defined between the tractor unit 20 and the fixing unit 22 representing the position where the paper top sensor 126 is activated. Lastly, a stop position SP is defined at a predetermined distance outside of the outlet 28.

Six predetermined intervals along the paper path 68 are defined in the printer 10 based on the above positions: interval L1 between the home position HP and the exposure start position ESP; interval L2 between the exposure start position ESP and the transfer position TP; interval L3 between the exposure start position ESP and the paper top sensor position PTS; interval L4 between the exposure start position ESP and the fixing position FP; interval L5 between the exposure start position ESP and the stop position SP; and interval L6 between the home position HP and the stop position SP.

The printing process is now described with reference to FIGS. 11 through 18. At the beginning of the printing process, the controller 24 checks the heat roller 128 to determine if the roller 128 is hot enough for fixing (S100). If the roller 128 is not hot enough (N at step S100), the controller calls a warm-up operation (S102) which activates the heating element (for example, a halogen lamp) until the roller 128 is heated to a fixing temperature. Otherwise (Y at step S100), the controller 24 proceeds directly to step S104, where a feed pulse interval (i.e., ⅙, ⅛" or ½") is selected by the selector 124 according to the paper length (input from the operation panel 125 or the host computer 196). A default value may also be set such that, it no data is available from the operation panel 125 or the host computer 196 regarding the paper length, the paper length is set to, for example, 11".

The controller 24 then checks the paper top sensor 126 at step S106. If the paper top sensor 126 is OFF (N in step S106); it indicates that the paper P has not reached the paper top sensor 126. In this case, the top set operation shown in FIG. 16 and described below is initiated. If the paper top sensor 126 is ON (Y at step S106), it indicates that the paper P has reached the paper top sensor 126, and the controller proceeds to step S108. In step S108 through S112, the controller 24 starts the laser scanning unit 14, the main motor 82 for driving the developing unit 18, and the fixing unit motor 86 for driving the fixing unit 22, respectively.

At step S114, a counter A is set according to the predetermined interval L6 and the selected feed pulse interval. Defining the selected feed pulse interval as "m", the counter A is set to L6/m. After the counter A is set, a feed pulse interrupt process is enabled in step S116.

Figure 12:
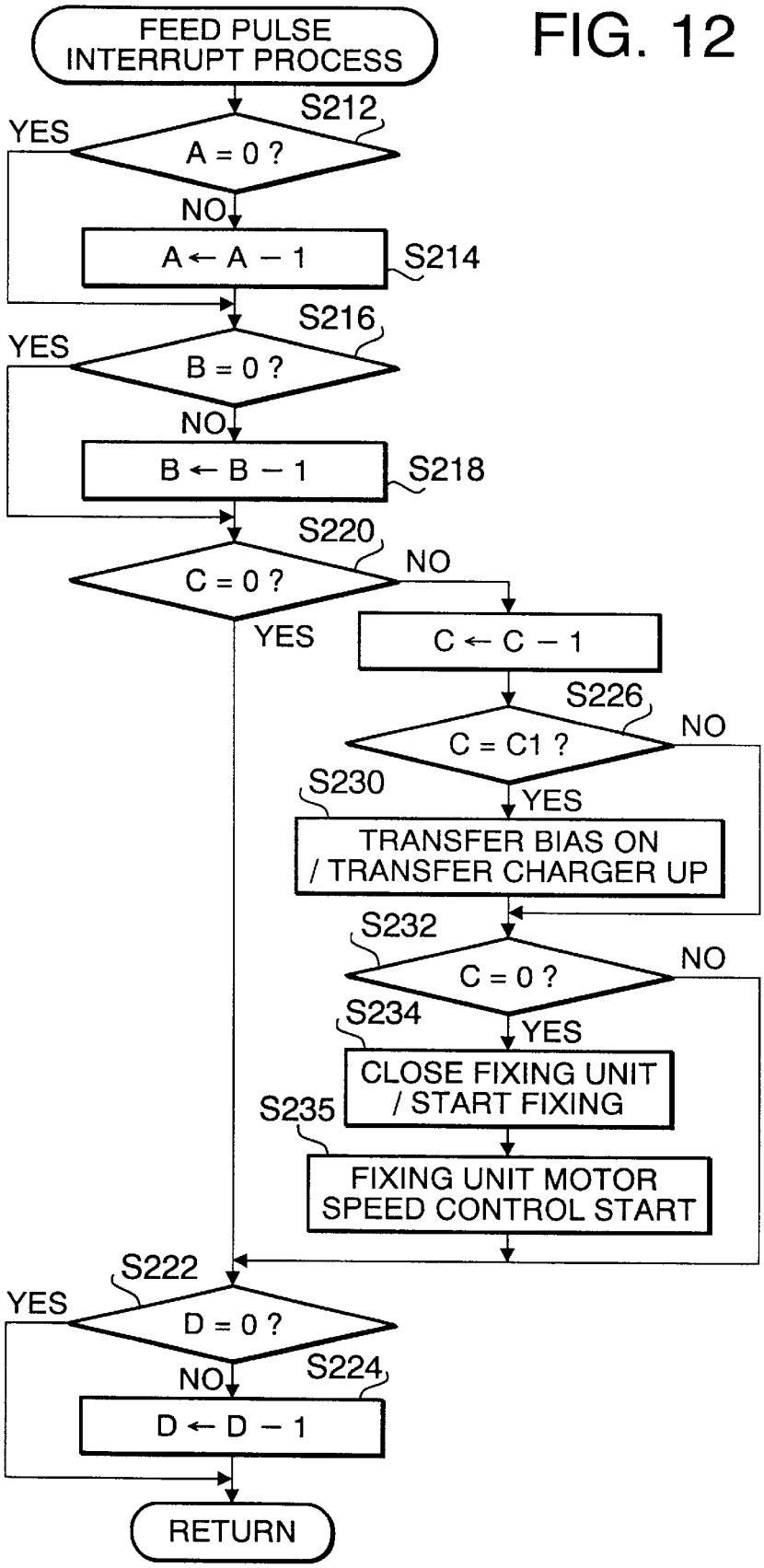
FIG. 12 is a flow chart showing a feed pulse interrupt process.

The feed pulse interrupt process is described with reference to FIG. 12. The feed pulse interrupt process interrupts a running process when the controller 24 receives a feed pulse from the selector 124. Generally, the feed control of the embodiment is performed by setting a certain value (based on the distance to be fed) in a counter, and decrementing the counter by 1 at every feed pulse sent to the controller 24 In particular, the controller 24 includes the counter A (described above) which is used for feed in the reverse direction, a counter B used for feed in the forward direction, and counters C and D used for controlling the pressure roller 130 or the like between a retracted position (retracted from the paper path) and an operating position. In FIG. 12, the controller 24 checks and conditionally decrements counters A, B, C and D in order (S212 through 224). More particularly, the counter A is checked to see if it is zero (S212), and the counter A is only decremented by 1 if it is not zero (S214). Similarly, counters B and D are checked (S216, S222), and only decremented by 1 if they are not zero (S218, S224). The case wherein the counter C is not zero is described below with reference to steps S140, S142 of FIG. 13.

Referring again to FIG. 11, after the feed pulse interrupt process is enabled in step 116, the tractor motor 84 is then driven in reverse to retract the paper P in step S118. The controller 24 then loops through a check of the paper top sensor 126 and the counter A until either the paper top sensor 126 is OFF or A reaches zero, checking the paper top sensor 126 first (S120, S122). If the paper top sensor 126 turns OFF before the counter A reaches zero, it indicates that a top edge of the paper P has been located, for example, if the last printed page has been separated from the paper P outside the printer 10, and that the leading edge of the current page defines the next blank page to be printed. At this point, the tractor motor 84 is stopped (S204) and the controller 24 proceeds to a semi-top set process as described below with reference to FIG. 16.

If the counter A reaches zero before the top sensor 126 is turned OFF, it indicates that the top edge of the paper P has not been located, for example, if the printed page has not been separated, and that the printed page has been pulled back into the printer 10. In this case, the tractor motor 84 is stopped (S124), and the controller 24 proceeds to print the following page as described in FIG. 13.

Figure 13:
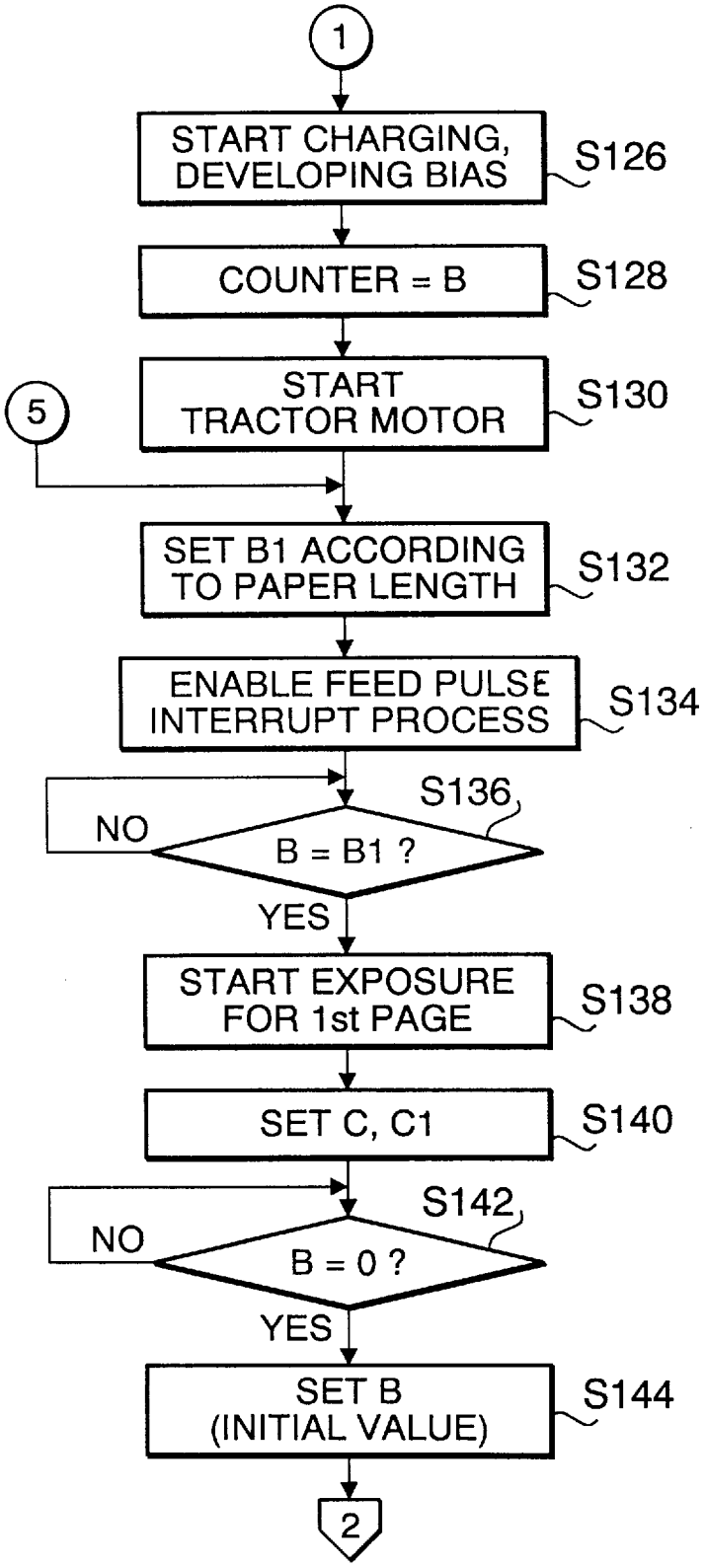
FIG. 13 is a flow chart showing a second part of the printing control process.

As shown in FIG. 13, in step S126, a bias voltage is applied to the charging unit 40 and the developer 18. At step S128, the counter B is set to (L1+L2)/m, based on the predetermined interval from the home position HP to the transfer position TP (L1+L2) and the selected feed pulse interval (m).

After B has been set, the controller 24 rotates the tractor motor 84 to transport the paper P (S130). At step 132, a count target B1 is set to L2/m, based on the interval from the exposure start position ESP to the transfer position TP (L2) and the selected feed pulse interval (m).

After B1 has been set, the interrupt process is enabled (S134), decrementing B for every detection of a pulse from the selector 124 (S134). When the counter B reaches B1 (S136), indicating that the leading perforations of the first page to print have reached the exposure starting position ESP, the controller 24 starts the laser scanning unit 14 and the scanning unit 14 begins scanning to form a latent image onto the surface of the photoconductive drum 16 (S138) at the laser scanning point LSP. The latent image becomes a toner image on the photoconductive drum 16 as it passes the developing unit 18.

At this point, the counter C is set to L4/m, based on the interval L4 from the exposure starting position ESP to the fixing position FP. Further a count target C1 is set at step S140 to (L4−L2)/m. The counter C is decremented when the pulse feed interrupt routine of FIG. 12 is called after a feed pulse is received by the controller 24. In particular, referring to FIG. 12, the counter C is decremented by 1 at step S226 and then when the counter C has reached the value C1, indicating that the perforations of the next page are at the transfer position TP, a bias voltage is applied to the transfer charger 46 and the transfer unit 44 is moved into its operating position (S230). When the counter C is zero (S232), the pressure roller 130 is moved to abut the heat roller 128 for a fixing operation (S234). A detailed description of the operation of the fixing unit and transfer unit is omitted.

Referring back to FIG. 13, when the counter B reaches zero (S142), indicating that the leading perforations of the page to be printed have reached the transfer position TP, the controller 24 energizes the transfer unit 44 to begin transferring the toner image on the drum 16 to the paper P. Following step S142, the counter B is reset to (page length) /m, based on the paper length as set and the selected feed pulse interval (S144).

Figure 14:
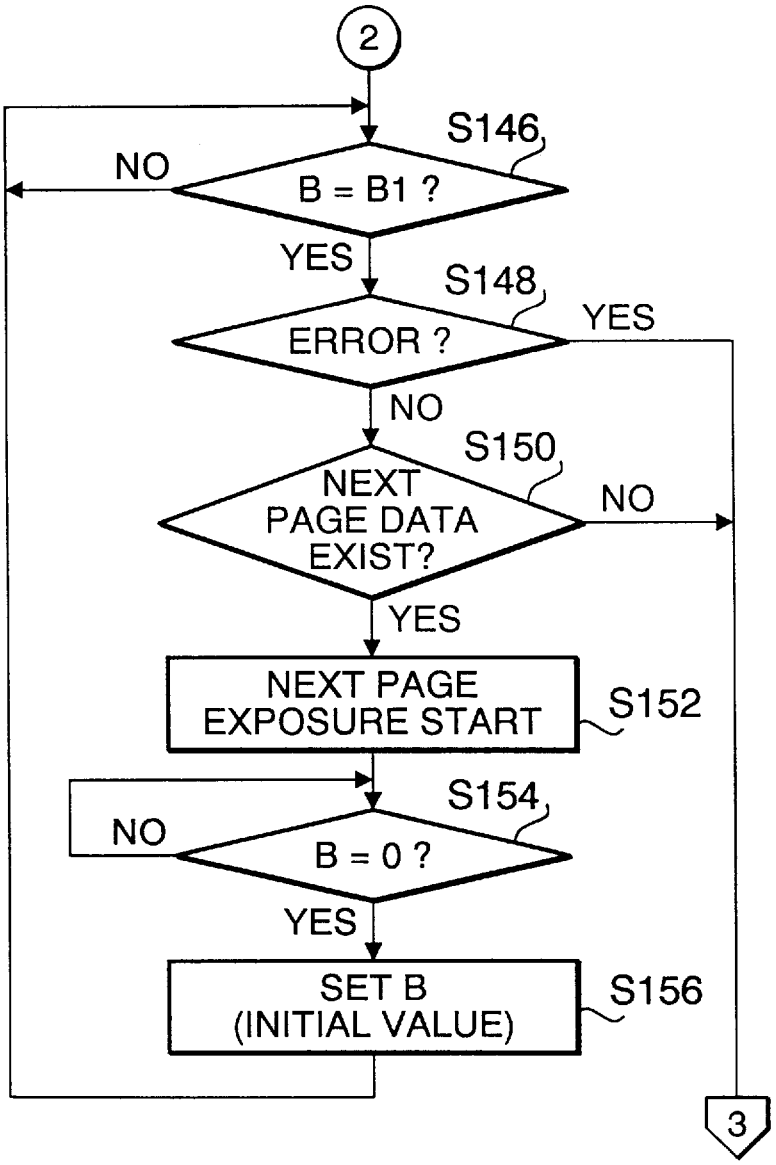
FIG. 14 is a flow chart showing a third part of the printing control process.
Figure 15:
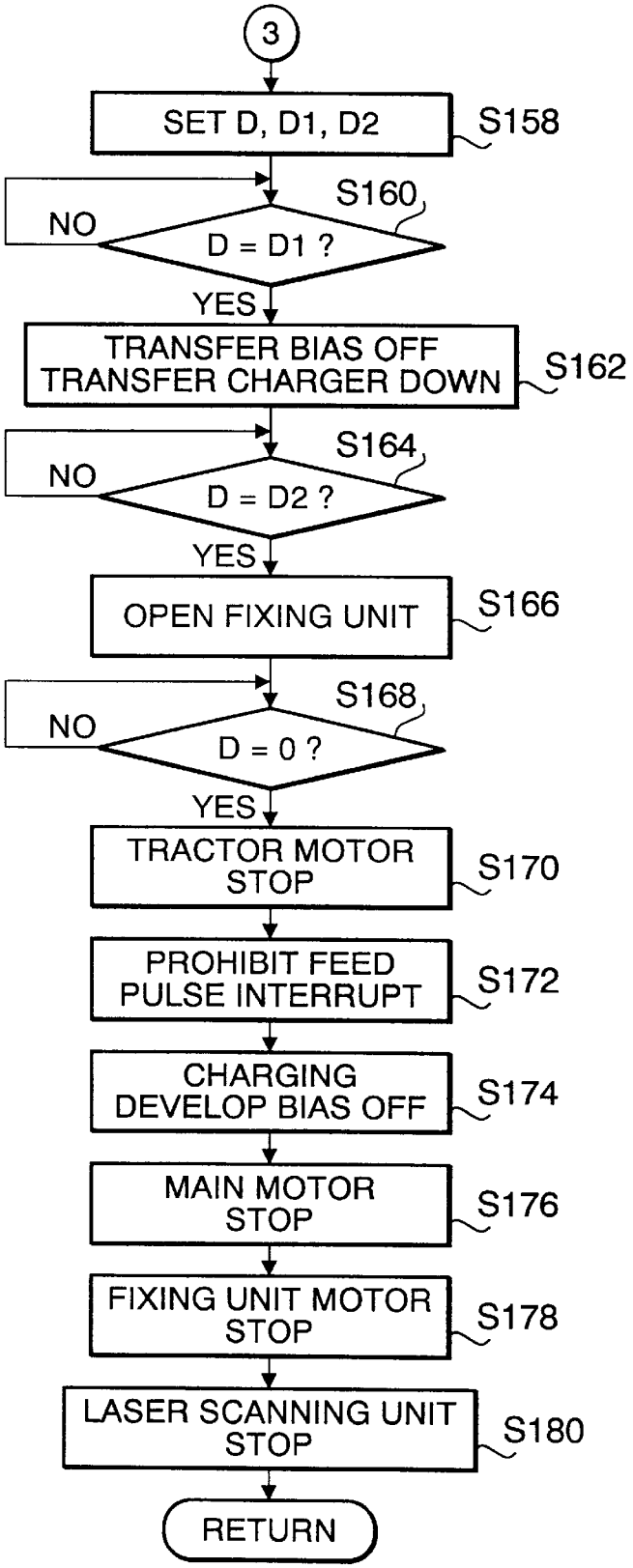
FIG. 15 is a flow chart showing a fourth part (print stop process) of the printing control process.

In step 144, the leading edge of the next page to be printed is defined. Continuous printing of successive pages is begun in FIG. 14. As shown in FIG. 14, when the counter reaches B1 (S146), indicating that the perforation of the next page has reached the exposure starting position ESP, an error check is performed (S148). If an error is detected, for example "toner out", "paper empty", or "no printing data" type errors (S150), the controller 24 proceeds to the print stop process (FIG. 15).

If no error is detected at step S148 or step S150, the controller 24 proceeds to expose the next latent image on the drum 16 and continues the printing process. At step S154, the counter B is again reset based on the paper P length as previously defined. In step S156, the leading edge of the page following the next page is defined, and the steps S145 through S156 are then repeated until no more printing data exists at step S150 (or until an error is detected at step S148), whereupon the controller proceeds to the print stop process as shown in FIG. 15.

During the print stop process, the feed pulse interrupt process of FIG. 12 continues to decrement the counter D for every feed pulse received by the controller 24. As shown in FIG. 15, the print stop process is initialized in step S158. A counter D is set to L5/m, based on the predetermined interval from the exposure start position ESP to the stop position SP (L5); a count target D1 is set to (value in D)−L2/m, based on the interval between the exposure start position ESP and the transfer position TP; and a target count D2 is set to (value in D)−L4/m, based on the interval between the exposure start position ESP and the fixing position FP.

When the counter D reaches the target value D1 (S160), indicating that the leading perforation defining the last printed page has reached the transfer position TP, the controller 24 stops the bias voltage to the transfer unit 44, and retracts the transfer unit 44 from the drum 16 (S162). When the counter D reaches D2 (S164), indicating that the perforations defining the last printed page has reached the fixing position FP, the controller 24 stops the fixing operation and moves the press roller 130 away from the heat roller 128 (S166). When the counter D value reaches zero (step S168), indicating that the perforation defining the last printed position has reached the stop position SP outside the printer 10, the controller 24 then: stops the tractor motor 84 (S170); prohibits the feed pulse interrupt process (S172); removes the biasing voltage from the charging unit 40 and the developing unit 18 (S174); stops the main motor 82 (S176); stops the fixing unit motor 86 driving the fixing unit 22 (S178); and stops the laser scanning unit 14 (S180).

The controller 24 controls the elements of the printer 10 so that the perforation of the last printed page reaches the stop position SP outside the printer 10 so that the operator may check or separate the last printed page.

Figure 16:
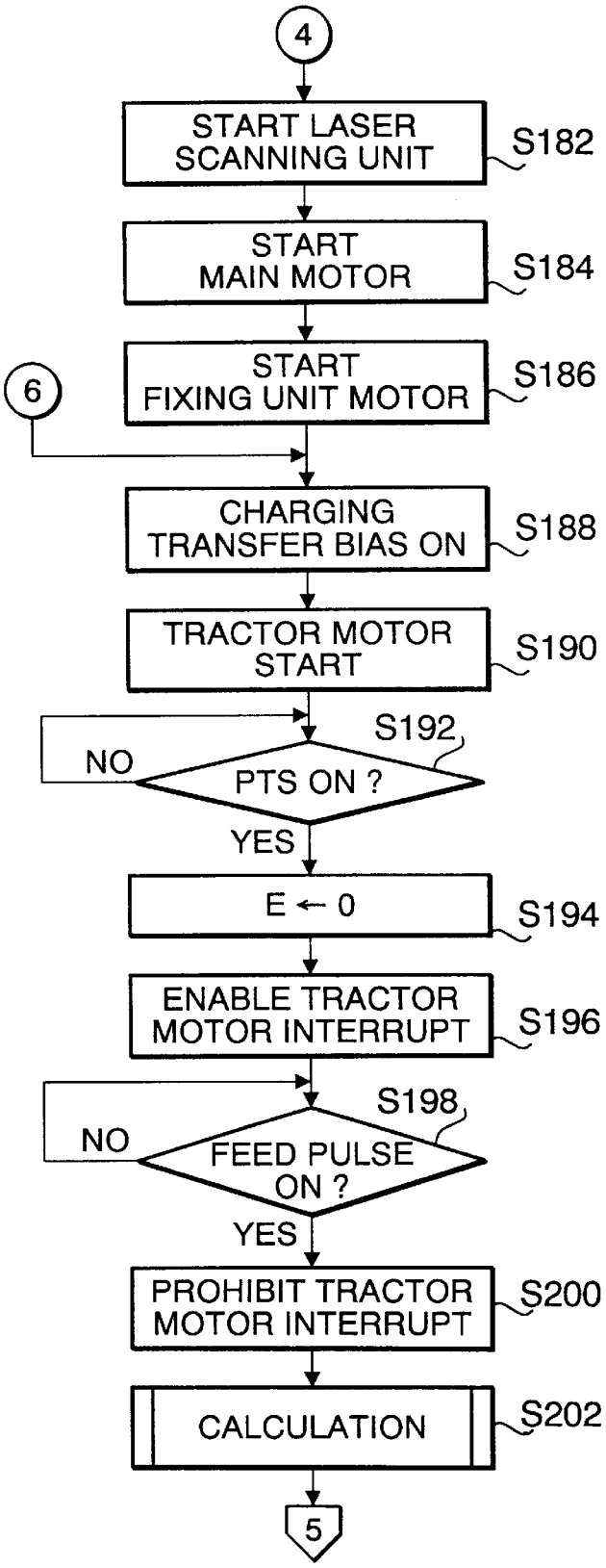
FIG. 16 is a flow chart showing a top set process of the printing control process.

FIG. 16 shows the top set operation, called at previously described step S106. The top set process is performed to find the perforations which are upstream from and closest to the exposure starting position ESP. The top set process is performed after the paper P is set in the printer, or following a retraction, to properly register the paper P before printing. A portion of the top set process serves as the semi-top set operation (called at previously described step S204).

At the beginning of the top set operation, the laser scanning unit 14 (S182), the main motor 82 driving the developing unit 18 (S184), and the fixing unit motor driving the fixing unit 22 (S186) are started, and a bias voltage is applied to the charging unit 40 and the developing unit 18 (step S188). The semi-top operation skips the first three steps (i.e., S182, S184, S186) as, in this case, the elements started in the three skipped steps have already been activated, and is otherwise identical to the top set operation.

Figure 17:
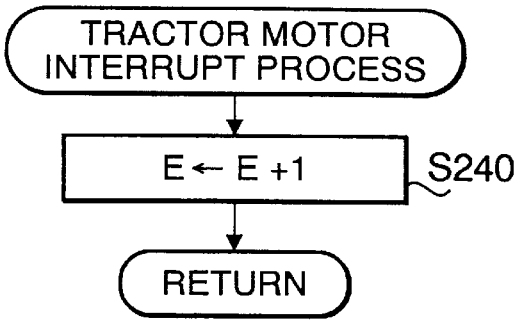
FIG. 17 is a flow chart showing a tractor motor phase pulse count interrupt process.

At step S190, the tractor motor 84 is rotated to transport the paper P (S190). The controller loops until the paper top sensor 126 turns ON (S192), and then sets a motor pulse counter E to zero. The motor pulse interrupt is then enabled (S196). As the tractor motor 84 rotates, for every motor pulse of the tractor motor 84, the interrupt of FIG. 17 is activated. Thus, as shown in FIG. 17, the counter E is incremented by 1 for every phase pulse of the tractor motor 84 (S240) only when the tractor motor pulse interrupt is enabled. The motor pulses are sent to the controller 24 by a motor monitor circuit (not shown).

The controller then loops until the next teed pulse is sent to the controller 24 (S198). At this point, the motor pulse interrupt is prohibited (S200). The controller 24 then sets counter B to a value, representative of the interval from the exposure start position ESP to the closest upstream perforations, according to the calculation of FIG. 18 (S202).

The calculation of step S202 of the top set process is described with reference to FIG. 18. The distance L for feeding the paper P to position the closest perforation to the home position HP is determined according to:

$$L=(L3+L1)-\text{page length}*n \quad (1)$$

where n is an integral number of pages which can be located between the page top sensor position PTS and the home position HP.

Figure 3:
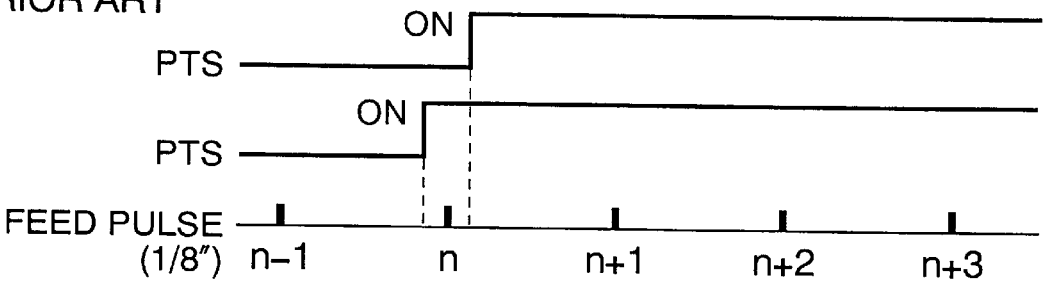
FIG. 3 PRIOR ART
FIG. 3 is a schematic view of a relationship between ⅛" feed pulses and paper top signal from a paper top sensor.
Figure 18:
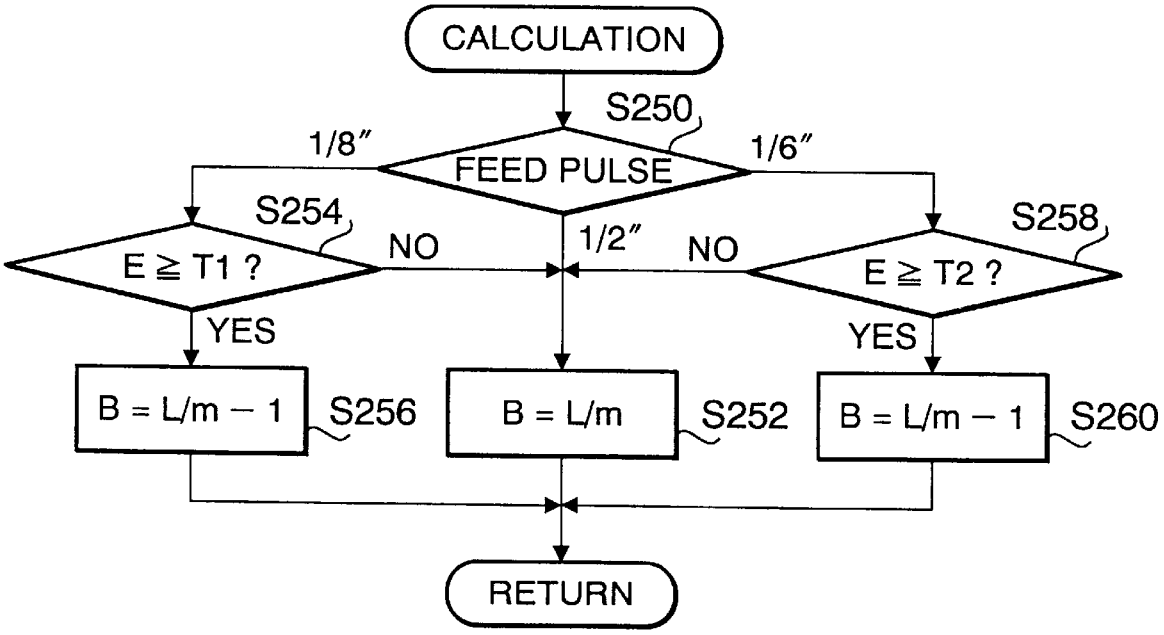
FIG. 18 is a flow chart showing a calculation of the top set process.

In the calculation shown in FIG. 18, generally, the controller 24 checks if there is a delay in signal from the paper top sensor 126 (such as that shown in FIG. 3). If a delay is recognized, the controller 24 changes the feeding amount of feeding the paper P to position the perforation to the home position HP, thereby to compensate for a delay of the leading edge. In particular, the controller 24 first checks which feed pulse interval is selected (S 250). If the feed pulse of ½" is selected, no compensation is necessary. Thus, the controller 24 proceeds to the step S252, where the counter B is set to L/m. If the feed pulse interval of ⅛" is selected, the controller 24 compares the counted motor pulse E and a predetermined threshold T1 (S254). If the counted motor pulse is smaller than the threshold T1, the controller 24 proceeds to the step S252, where the counter B is set to L/m. If the counted motor pulse is greater than the threshold T1, it indicates that the signal from the paper top sensor 126 is delayed as shown in FIG. 3. Thus, the controller 24 proceeds to the step S256, where the counter B is set to L/m−1.

Similarly, if the feed pulse interval of ⅙" is selected, the controller 24 compares the counted motor pulse E and a predetermined threshold T2 (S258). If the counted motor pulse is smaller than the threshold T2, the controller 24 proceeds to the step S252, where the counter B is set to L/m. If the counted motor pulse is greater than the threshold T2, the controller 24 proceeds to the step S260, where the counter B is set to L/m−1.

By determining the threshold values T1 and T2 during the assembly of the tractor unit 20 based on the positions of the paper top sensor 126 and the first and second sensors 120 and 122, and then using the above process, the controller 24 positions the perforations precisely at the home position HP.

However, after assembling the tractor unit 20 to the printer 10, there may be a misalignment a deviation of the scanning laser beam from the designed path. Thus, the compensating process for the deviation of the scanning position is now described.

Figure 4:
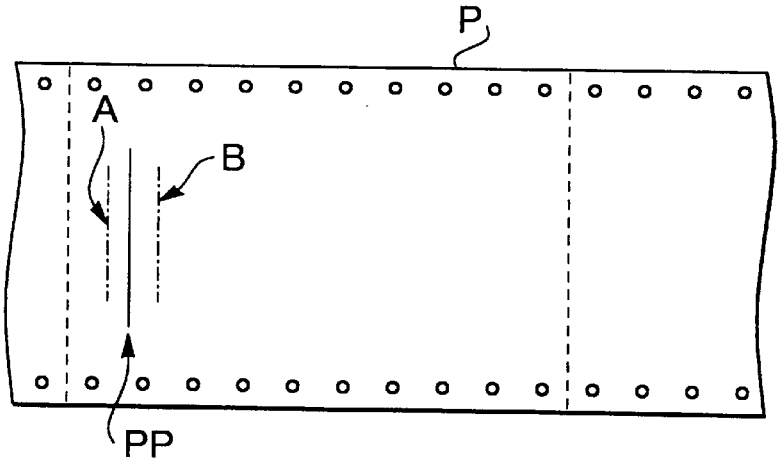
FIG. 4 PRIOR ART
FIG. 4 is a schematic view of a deviation of printing position on a continuous form paper.

After the printer is assembled, a printing test is performed selecting a ½" feed pulse interval. As shown in FIG. 4, if the printing test shows that the printing starting position (shown by PP) on the paper P deviates downstream (shown by A) or upstream (shown by B), the timing of the feed of the paper P can be advanced or delayed according to the result of the printing test by adjusting the position of the first and second sensors 120 and 122 downstream or upstream by an amount of the deviation.

If the position of the first and second sensors 120 and 122 is changed, the relationship between the signal from the paper top sensor 126 (paper top signal) and the feed pulse interval is also changed. Accordingly, the threshold values T1 and T2 used in the calculation process in the top set operation in FIG. 16 become invalid.

However, in this embodiment, since the position of the paper top sensor 126 is also adjustable, the relationship between the feed pulse and signal from the paper top sensor 126 can be maintained. For adjusting of the position of the paper top sensor 126, the paper P is fed using a feed pulse interval of ⅛" and the time after the signal is sent from the paper top sensor 126 before the next feed pulse is generated is measured. Then the position of the paper top sensor 126 is adjusted until the measured time becomes a predetermined value.

As constructed above, the printing position on the paper P can be adjusted to compensate for error in the scanning position while keeping the relationship between the signal from the paper top sensor 126 and the feed pulse interval unchanged.

Figure 19:
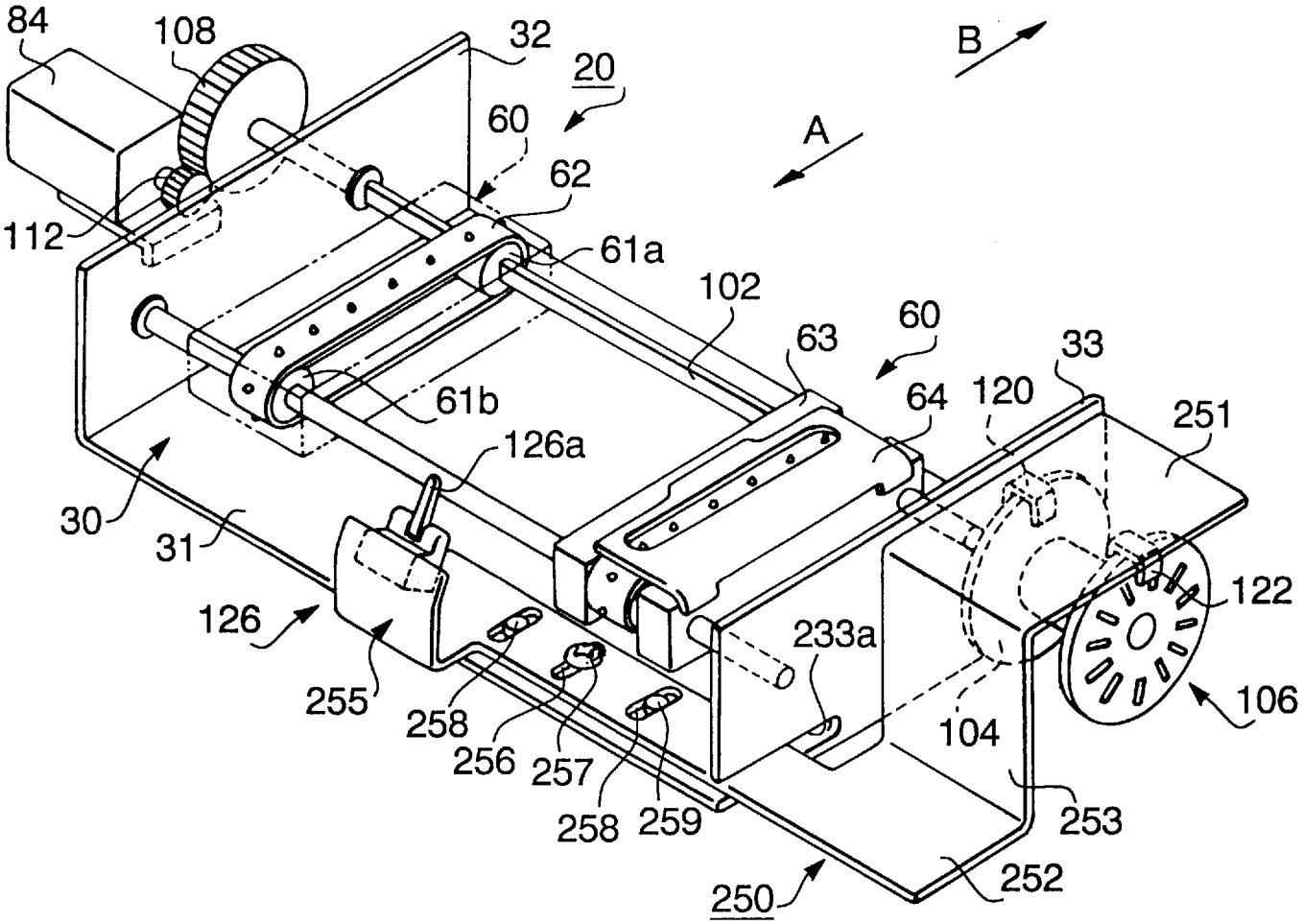
FIG. 19 is a perspective view of a tractor unit of a second embodiment.

A second embodiment of the present invention is now described. In the second embodiment, the paper top sensor 126 is arranged to be unitarily moved with the first and second sensors 120 and 122. As shown in FIG. 19, the paper top sensor 126 is fixed to a unitary mounting plate 250. The mounting plate 250 extends between the center of the tractor frame 20 to the exterior of the side wall 33, protruding through a groove 233*a* formed on the side wall 33. A protruding end 252 of the mounting plate 250 further extends rearward (the direction of the arrow B) at the exterior of the side wall 33 and is bent upward to form an upright portion 253 and is further bent to the rear at the top of the upright portion to form a top plate 251. The first and second sensors 120 and 122 are attached to a bottom surface of the top plate 251. The other end of the mounting plate 250 extends frontward and is bent upward to form a center upright portion 255, to which the paper top sensor 126 is secured.

The bottom portion 252 is provided with an elongated hole 256 that extends in the paper feeding direction. A screw 257 is inserted through the elongated hole 256 and is engaged to a hole (not shown) on the bottom plate 31. Further, for guiding the mounting plate 250 in the paper feeding direction, the mounting plate 250 has two guide grooves 258 extending in the paper feeding direction, which engage with a square boss 259 provided on the bottom plate 31.

As constructed above, the position of both the paper top sensor 126 and the first and second sensors 120 and 122 can be adjusted by loosening the screw 257, moving the mounting plate 250 and tightening the screw 257.

Figure 20:
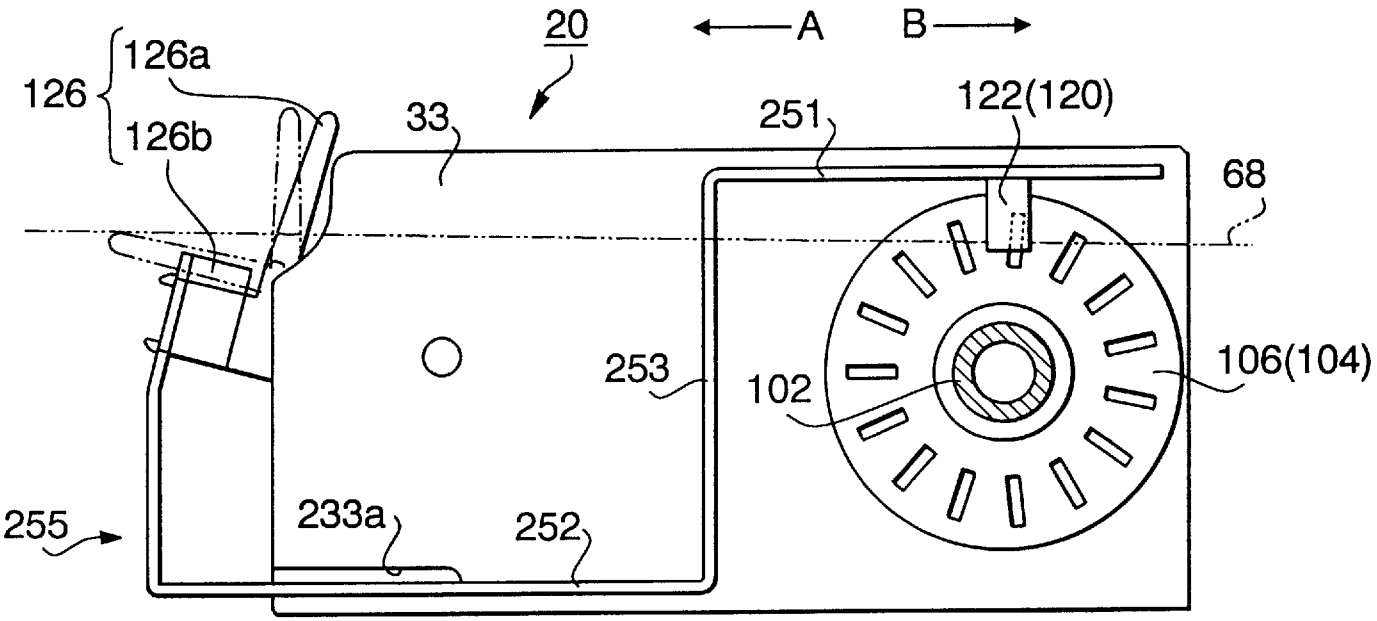
FIG. 20 is a side view of the tractor unit of FIG. 19.
Figure 21:
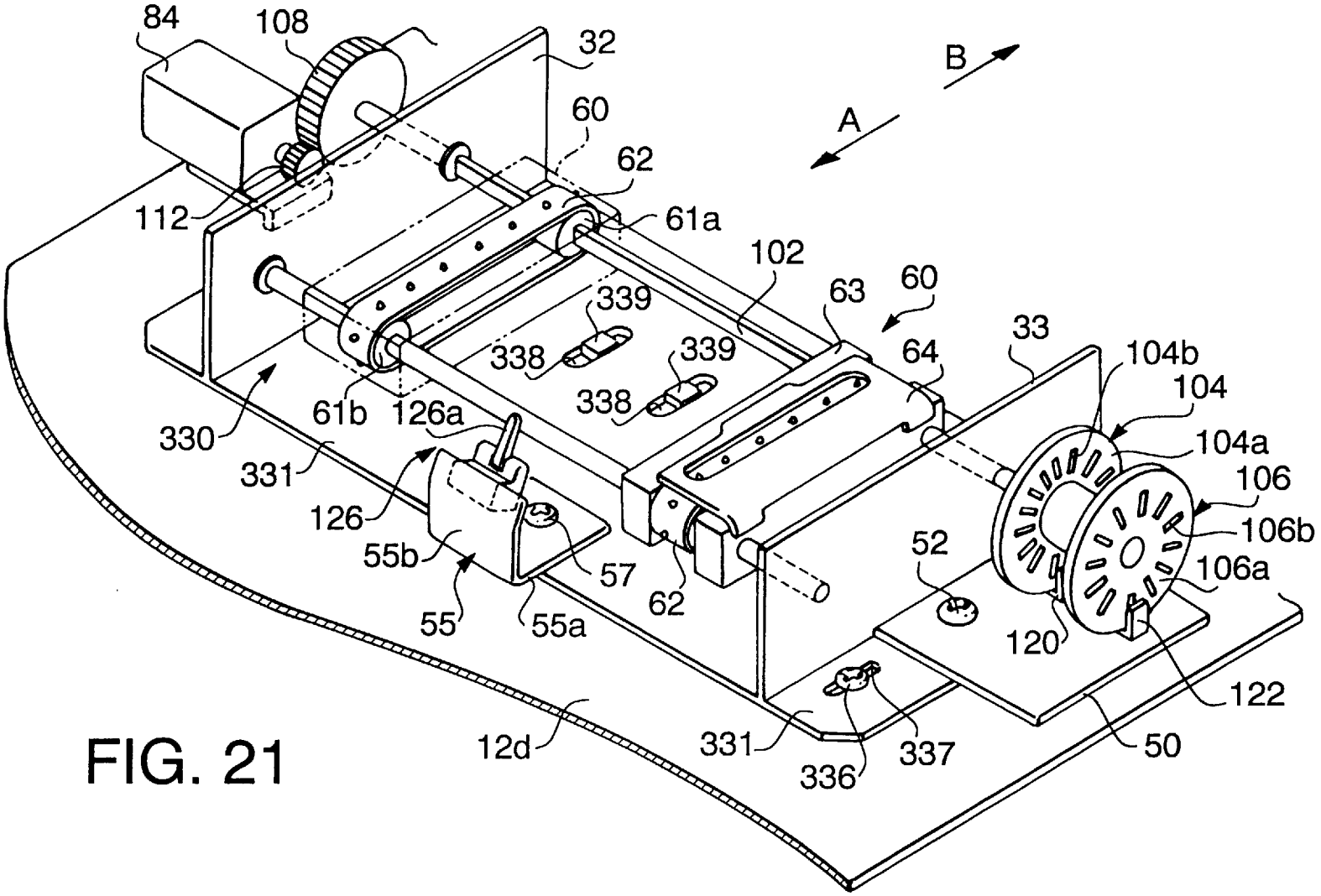
FIG. 21 is a perspective view of a tractor unit of a third embodiment.

In this embodiment, as shown in FIG. 20, the second (first) sensor 122 (120) detects the slits of the second (first) encoder 106 (104) at the same height as the paper path 68. Further, a movement of the mounting plate 250 results in a movement of the first and second sensors 120 and 122 relative to the rotation of the first and second encoders 104 and 106 in the same direction as the movement of the paper top sensor 126 relative to the advance of the paper P.

With the arrangement of the second embodiment, if a printing test (after assembling the printer) shows that the printing starting position (shown by PP in FIG. 3) on the paper P deviates downstream (shown by A) or upstream (shown by B), the position of the first and second sensors 120 and 122 is changed downstream or upstream by an amount of the deviation, by moving the mounting plate 250. Since the paper top sensor 126 is unitarily mounted on the mounting plate 250 and the first and second sensors 120 and 120 are appropriately positioned with respect to the height of the paper path 68 and the rotation of the first and second encoders 104 and 106, the paper top sensor 126 is also adjusted by the same amount. Thus, the relationship between the signal from the paper top sensor 126 and the feed pulse interval remains unchanged.

As constructed above, according to the second embodiment, the printing position on the paper P can be adjusted without changing the relationship between the signal from the paper top sensor 126 and the feed pulse interval.

Figure 22:
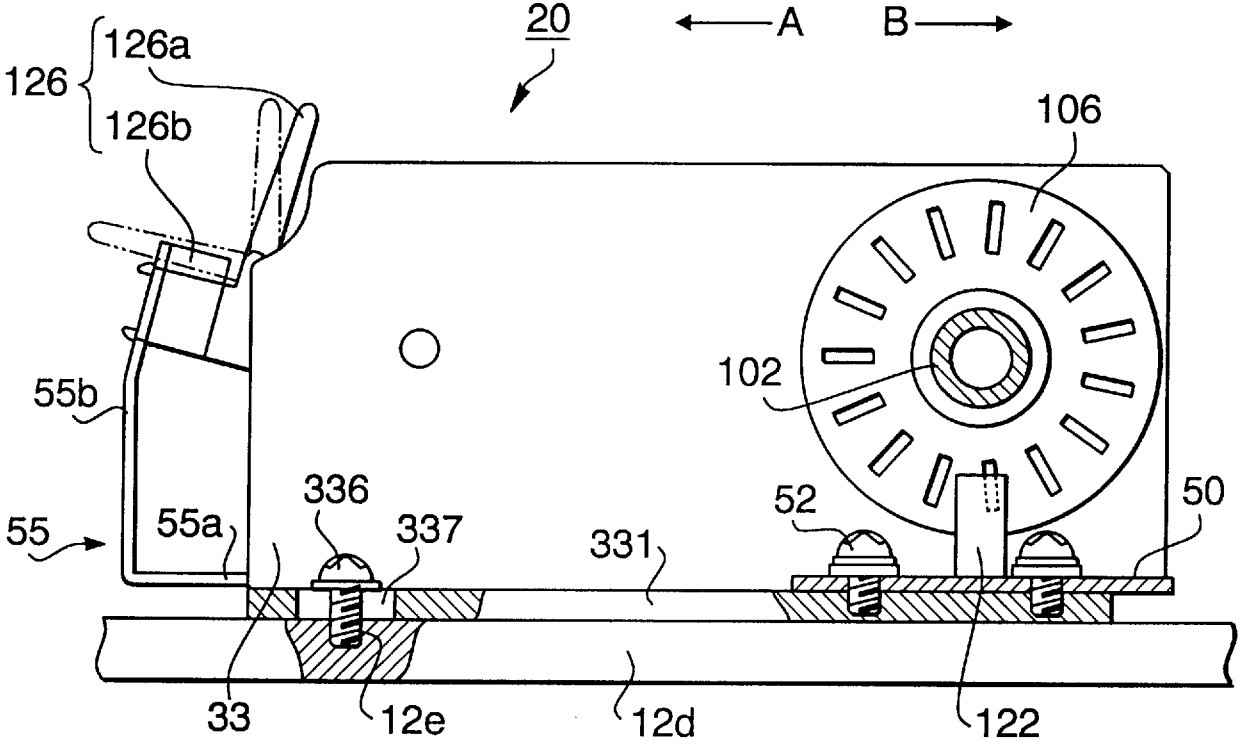
FIG. 22 is a side view of the tractor unit of FIG. 21.

A third embodiment of the invention is now described. In the third embodiment, the tractor unit 20 is provided with a tractor frame 330 which is movable in relation to the main chassis 12*d*. An elongated hole 337 is formed on a bottom plate 331 of the tractor frame 330, extending in the feeding direction (direction A, B) through which a screw 336 is engaged with a threaded hole 12*e* (shown in FIG. 22) formed on the bottom plate 331 Further, two guiding grooves 339 are formed on the bottom plate 331, extending in the feeding direction.

With this arrangement, if a printing test (after assembling the printer) shows that the printing starting position (shown by PP) on the paper P deviates downstream (shown by A) or upstream (shown by B), the position of the tractor frame 330 is changed downstream or upstream by the same amount as the deviation. Since the paper top sensor 126 and the first and second sensors 120 and 122 are mounted to the tractor frame 330, the relationship between the signal from the paper top sensor 126 and the feed pulse interval is not changed by the adjustment.

As constructed above, according to the third embodiment, the printing position on the paper P can be adjusted without changing the relationship between the signal from the paper top sensor 126 and the feed pulse interval.

Figure 23:
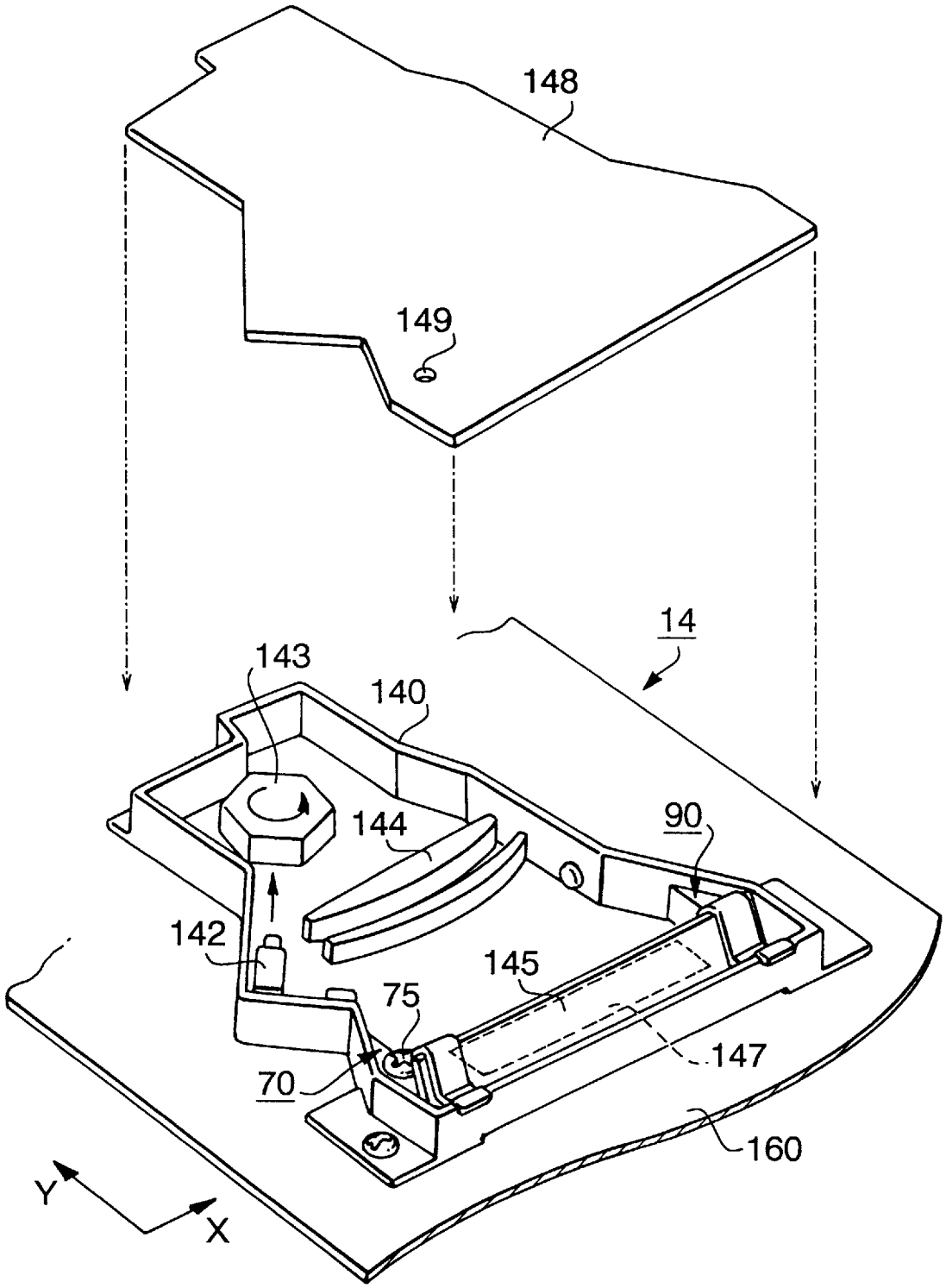
FIG. 23 is a perspective view of a laser scanning unit of a fourth embodiment.

A fourth embodiment of the invention is now described. FIG. 23 is a perspective view of the scanning unit 14. As shown in FIG. 23, a laser diode 142, polygon mirror 143, Fθ lens 144, and mirror 145 are arranged in a casing 140. The laser diode 142 is a light source. The polygon mirror 143 scans the light from the laser diode 142. The Fθ lens 144 forms an image on an image surface. The mirror 143 reflects the light from the Fθ lens 143 to the drum 16 (FIG. 4).

A cover plate 148 is provided on the top of the casing 140. A rectangular opening 147 is provided on the bottom plate of the casing 140, through which the light from the mirror 145 is introduced to the drum 16.

The longitudinal direction of the casing (y axis) is the same as the paper feeding direction of the tractor unit 20. Further, the scanning direction of the polygon mirror 143 is the same as the width direction of the paper P. As shown in FIG. 23, the mirror 145 is held by first holding portion 70 and second holding portion 90 at longitudinal ends thereof in such a manner that the mirror 145 is inclined at a predetermined angle in order to redirect the light to the photoconductive drum 16.

Figure 24:
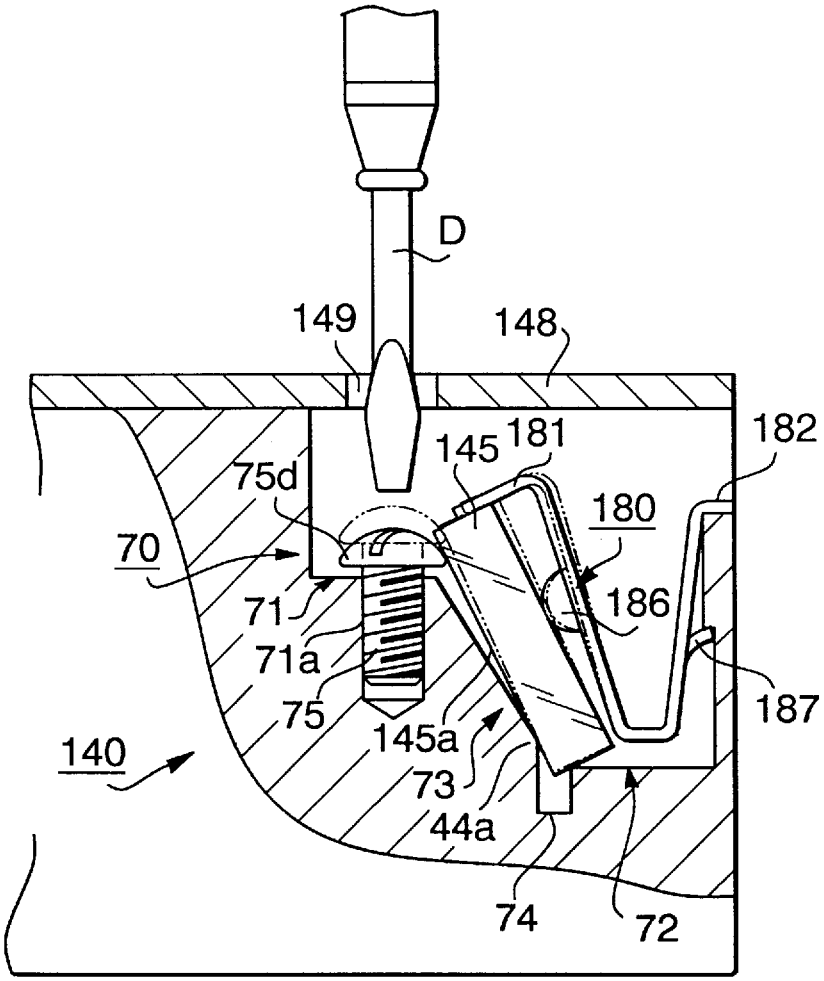
FIG. 24 is a cross section of a first holding portion of the laser scanning unit of FIG. 23.

FIG. 24 is a sectional view of the first holding portion 70. The first holding portion 70 includes flat upper and lower ridges 71 and 72 and an intermediate slope 73 between the ridges 71 and 72. A recess 74 is formed between the lower ridge 72 and the slope 73.

Figure 25:
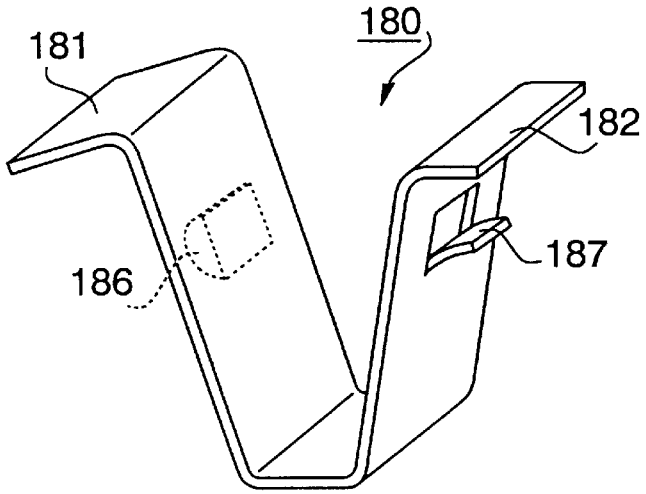
FIG. 25 is a perspective view of a plate spring.
Figure 26:
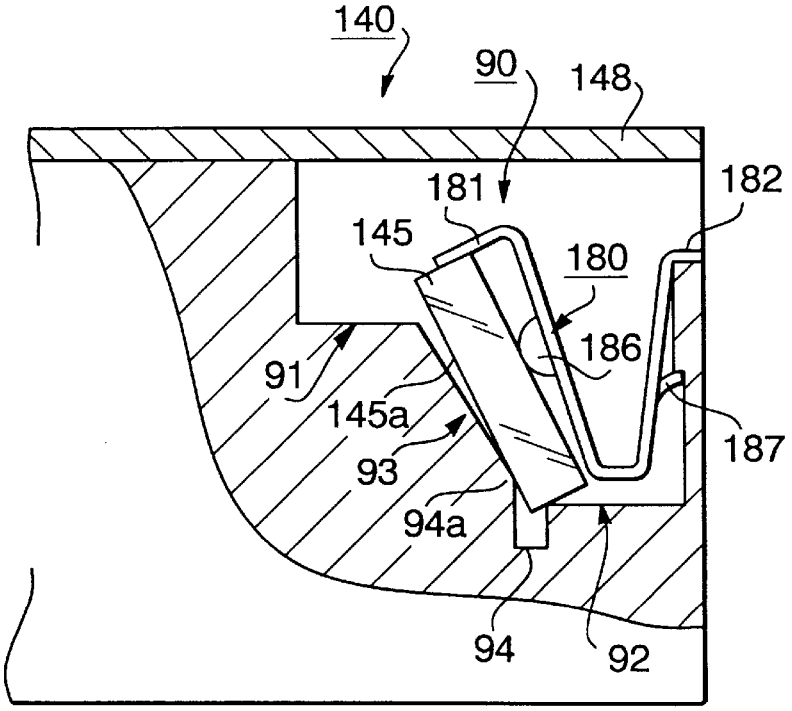
FIG. 26 is a cross section of a second holding portion of the laser scanning unit of FIG. 23.

The upper ridge 71 is provided with a threaded hole 71*a* into which an adjusting screw 75 is engaged. The adjusting screw 75 has a head portion 75*a* that is adjustable by use of a driver D that may be inserted through an operation hole 149 provided in a cover plate 148 of the laser scanning unit 14. A V-shaped plate spring 180 is provided at one side of the mirror 145. One end 182 of the plate spring 180 is fixed to the wall of the casing 140 and the other end 181 of the plate spring 180 abuts the top of the mirror 145 and the plate spring 180 further includes a protrusion 186 that abuts a rear side of the mirror 145 as shown in FIG. 25. Thus, the plate spring 180 applies a force pressing the mirror 145 downward and towards the intermediate slope 73. The mirror 145 is supported by the groove 74, the head 75*a* of the screw 75, and the plate spring 80. FIG. 26 shows the second holding portion 90. The holding portion 90 is constructed in a similar manner to the holding portion 70, except that the screw 75 and screw hole 71*a* are not required for the holding portion 90.

As constructed above, the inclination of the mirror 145 is changed by adjusting the engaging amount of the screw 75. With this arrangement, if a printing test (after assembling the printer) shows that the printing starting position (shown by PP) on the paper P deviates downstream (shown by A) or upstream (shown by B), this deviation is adjusted by changing the inclination of the mirror 145. That is, a cover 11 of the upper housing 12*c* of the printer 10 is opened, a tool (driver D) is inserted through the operation hole 149, and the screw 75 is adjusted up or down. For example, if the screw 75 is turned counterclockwise, the inclination of the mirror 145 is decreased and the printing position (PP) is adjusted accordingly. If the screw 75 is turned clockwise, the inclination of the mirror 145 is increased. The operation hole 149 is sealed after completing the adjustment, using, for example, tape.

As constructed above, the position of the scanning laser beam on the photoconductive drum 16 is corrected in a simple manner while maintaining the relationship between the signal from the paper top sensor 126 and the feed pulse interval.

Figure 27:
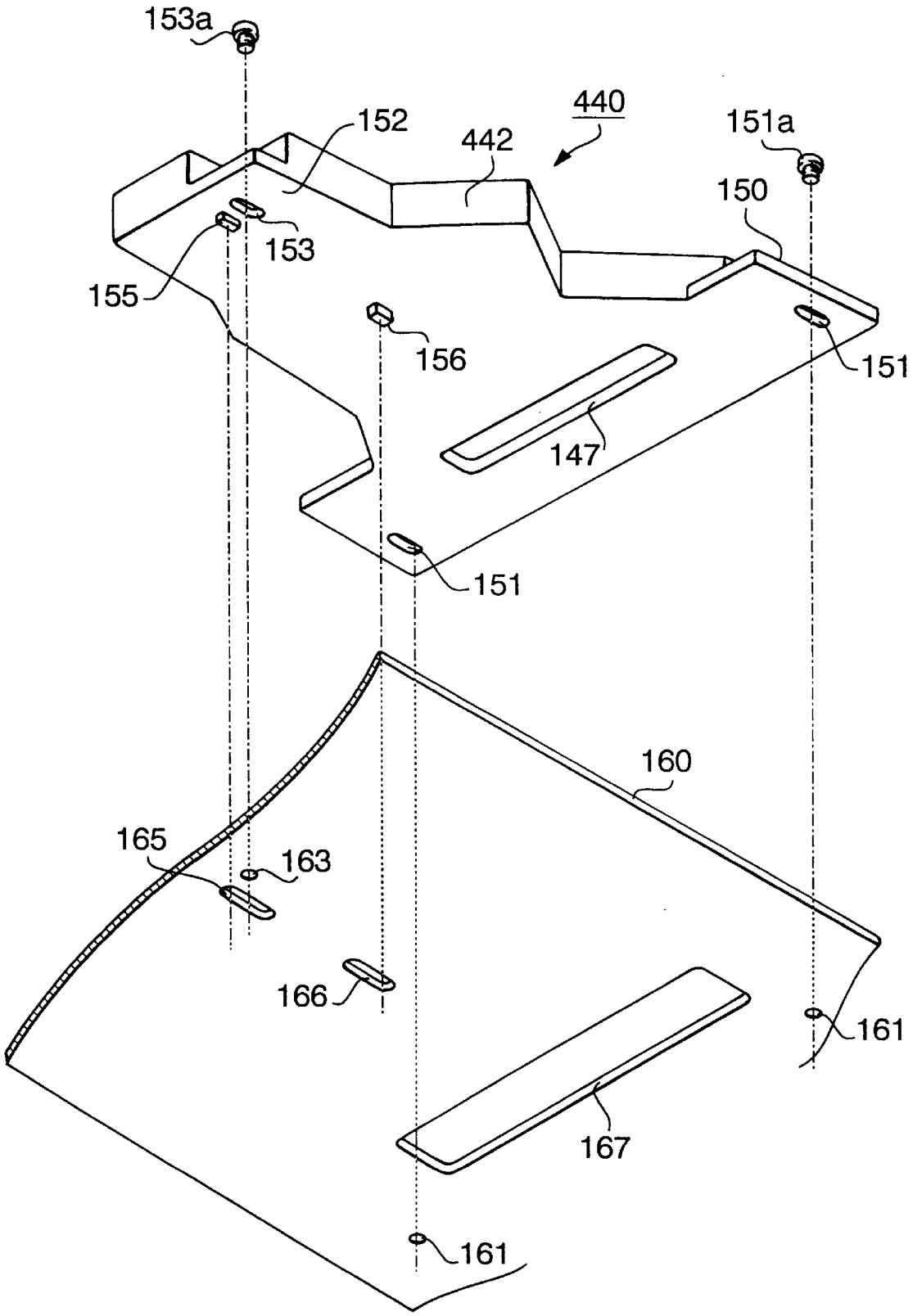
FIG. 27 is a bottom perspective view of a laser scanning unit of a fifth embodiment.

A fifth embodiment of the invention is now described. FIG. 27 is a bottom perspective view of a scanning unit 440. The scanning unit 440 of the fifth embodiment is so constructed that a casing 442 is slidable on the support plate 160 of the upper portion 12*c* of the printer 10. Two plate portions 150 are provided at an end of the casing 442, each of which is provided with an elongated hole 151. Similarly, a plate portion 152 is provided at another end of the casing 442, which includes an elongated hole 153. The elongated holes 151, 153 extend in the y-axis direction (the same direction as the paper feed direction).

The casing 442 is secured to the support plate 160 by engaging screws 151*a*, 153*a* inserted through the elongated holes 151, 153 to engage with threaded holes 161, 163 provided on the support plate 160. Rectangular bosses 155, 156 are provided projecting downward on the bottom surface of the casing 442 to engage with elongated guide grooves 165 and 166 formed on the support plate 160. The elongated guide grooves 165, 166 also extend in the y-axis direction (same direction as the paper feed direction) in order to guide the casing 442 in the y-axis direction.

With this arrangement, if a printing test (after assembling the printer) shows that the printing starting position (shown by PP) on the paper P deviates downstream (shown by A) or upstream (shown by B), this deviation is adjusted by sliding the casing 140 of the scanning unit frontward or rearward respectively by the same amount as the deviation.

As constructed above, according to the fifth embodiment, the position of the scanning laser beam on the drum 16 may be corrected in a simple manner without changing the relationship between the paper top sensor 126 and the feed pulse interval.

The present disclosure relates to subject matter contained in Japanese Patent Applications No. HEI 08-088899, filed on Mar. 18, 1996, No. HEI 08-088900, filed on Mar. 18, 1996, No. HE 08-088901. filed on Mar. 18, 1996, No. HEI 08-093610, filed on Mar. 22, 1996, which are expressly incorporated herein by reference in their entireties.

What is claimed is:

1. A printer using continuous form paper, comprising:

a tractor unit for feeding said paper;

a feed pulse generating system that generates a feed pulse in response to a feeding interval;

a paper top sensor for detecting the leading edge of said paper and generating a paper top signal;

a controller which controls said tractor unit according to said feed pulse; and a mechanism for adjusting a printing position on said paper, said adjusting mechanism maintaining a constant relationship between said feed pulse and said paper top signal wherein the position of said paper top sensor is adjustable with respect to said tractor unit.

2. The printer according to claim 1, wherein said feed pulse generating system comprises at least one encoder driven in synchronization with said tractor unit and at least one detecting sensor for detecting the movement of said encoder.

3. The printer according to claim 2, wherein the position of said detecting sensor is adjustable with respect to said encoder to change the timing of an issuance of said feed pulse.

4. The printer according to claim 2, wherein said detecting sensor is supported on a first support member, said first support member being slidably mounted to a tractor frame of said tractor unit.

5. The printer according to claim 4, wherein said paper top sensor is supported on a second support member, said second support member being slidably mounted to said tractor unit.

6. The printer according to claim 5, wherein said first and second support members are independently slidable with respect to one another.

7. The printer according to claim 5, wherein each of said first and second support members is provided with an elongated hole extending in a paper feeding direction and a screw fixed to said tractor frame extending through said elongated hole.

8. The printer according to claim 7, further comprising a guiding system that guides each of said first and second support members in a paper feeding direction with respect to said tractor frame.

9. The printer according to claim 8, wherein said guiding system comprises at least one groove formed on said support member and at least one pin formed on said tractor frame.

10. The printer according to claim 2, wherein said tractor unit comprises a pair of tractor belts and a pair of driving pulleys for driving said tractor belts, and wherein said encoder is mounted to a driving shaft of said driving pulleys.

11. The printer according to claim 2, wherein said detecting sensor comprises a photo-interrupter arranged to detect the passage of slits of said encoder.

12. The printer according to claim 2, wherein said detecting sensor and said paper top sensor are supported on a common support member, said common support member being slidably mounted to said tractor unit.

13. The printer according to claim 12, wherein said detecting sensor is positioned so that the direction of movement of said encoder with respect to said detecting sensor coincides with a paper feeding direction.

14. The printer according to claim 13, wherein said detecting sensor comprises a photo-interrupter arranged to detect the passage of slits of said encoder.

15. The printer according to claim 14, wherein said photointerrupter is positioned art a plane in which said paper is moved by said tractor unit.

16. The printer according to claim 15, further comprising a guiding system that guides said common support member in a paper feeding direction with respect to said tractor frame.

17. The printer according to claim 15, wherein said guiding system comprises at least one groove formed on said common support member and at least one pin formed on said tractor frame.

18. The printer according to claim 12, wherein said tractor unit comprises a pair of tractor belts and a pair of driving pulleys for driving said tractor belts, and wherein said encoder is mounted to a driving shaft of said driving pulleys.

19. The printer according to claim 12, wherein said common support member is provided with an elongated hole extending in a paper feeding direction and a screw fixed to said tractor frame extending through said elongated hole.

20. A printer using continuous form paper, comprising:

a tractor unit for feeding said paper;

a feed pulse generating system that generates a feed pulse in response to a feeding interval;

a paper top sensor for detecting the leading edge of said paper and generating a paper top signal;

a controller which controls said tractor unit according to said feed pulse; and a mechanism for adjusting a printing position on said paper, said adjusting mechanism maintaining a constant relationship between said feed pulse and said paper top signal;

wherein said feed pulse generating system comprises at least one encoder driven in synchronization with said tractor unit and at least one detecting sensor for detecting the movement of said encoder;

wherein said tractor unit, said encoder, said detecting sensor and said paper top sensor are unitarily provided in one frame that is supported on a base.

21. The printer according to claim 20, wherein the position of said frame adjustable in a paper feeding direction.

22. The printer according to claim 21, wherein said frame is provided with an elongated hole extending in a paper feeding direction and a screw fixed to a said base extending through said elongated hole.

23. The printer according to claim 21, further comprising a guiding system that guides said frame in a paper feeding direction with respect to said base.

24. The printer according to claim 23, wherein said guiding system comprises at least one groove formed on said common support member and at least one pin formed on said tractor frame.

25. The printer according to claim 21, wherein said tractor unit comprises a pair of tractor belts and a pair of driving pulleys for driving said tractor belts, and wherein said encoder is mounted to a driving shaft of said driving pulleys.

26. The printer according to claim 25, wherein said detecting sensor comprises a photo-interrupter arranged to detect the passage of slits of said encoder.

27. A printer using continuous form paper, comprising:

a tractor unit for feeding said paper;

a scanning unit for emitting light according to a pattern to be printed;

a photo-conductive member which receives said light to form a latent image of said pattern;

a system that develops said latent image on said photo-conductive member, transfers said developed image onto said paper and fixes said transferred image onto said paper; and an adjusting mechanism for adjusting the position of the emitted light of said scanning unit on said photo-conductive member, said adjusting mechanism being operable when said scanning unit is mounted on said printer;

wherein said scanning unit comprises a reflecting member for directing said emitted light to said photo-conductive member, and wherein a reflecting angle of said reflecting member can be adjusted;

wherein said reflecting member is supported by an abutting member and a biasing member which biases said reflecting member so that said reflecting member abuts said abutting member.

28. The printer according to claim 27, wherein said photo-conductive member is a photoconductive drum.

29. The printer according to claim 28, wherein said adjusting mechanism provides for an adjustment of said position of said emitted light around the circumference of said photo-conductive drum.

30. The printer according to claim 27, wherein said abutting member is a screw member and a threaded hole formed on a casing of said scanning unit, said screw member being engaged in said threaded hole.

31. The printer according to claim 30, wherein said casing of said scanning unit is provided with an opening through which a tool can be inserted to operate said screw member.

32. The printer according to claim 31, wherein said opening is sealed by a sealing member after adjustment of said reflecting angle of said reflecting member.

33. A printer using continuous form paper, comprising:

a tractor unit for feeding said paper;

a scanning unit for emitting light according to a pattern to be printed;

a photo-conductive member which receives said light to form a latent image of said pattern;

a system that develops said latent image on said photo-conductive member, transfers said developed image onto said paper and fixes said transferred image onto said paper; and an adjusting mechanism for adjusting the position of the emitted light of said scanning unit on said photo-conductive member, said adjusting mechanism being operable when said scanning unit is mounted on said printer;

wherein said scanning unit is housed in a casing, said casing being shiftable on a base in a paper feeding direction.

34. The printer according to claim 33, wherein said casing is provided with an elongated hole extending in a paper feeding direction and a screw fixed to said base extending through said elongated hole.

35. The printer according to claim 34, further comprising guiding system that guides said casing in a paper feeding direction with respect to said base.

36. The printer according to claim 34, wherein said guiding system comprises at least one groove formed on said casing and at least one pin formed on said base.

* * * * *

UNITED STATES PATENT AND TRADEMARK OFFICE

CERTIFICATE OF CORRECTION

PATENT NO. : 5,839,046

DATED : November 17, 1998

INVENTOR(S) : M. TAKANO et al.

It is certified that error appears in the above-identified patent and that said Letters Patent is hereby corrected as shown below:

At column 16, line 52 (claim 15, line 2) of the printed patent, "art" should be —at—.

Signed and Sealed this

Twenty-ninth Day of February, 2000

*Attest:*

*Attesting Officer*

Q. TODD DICKINSON

*Commissioner of Patents and Trademarks*